US008434859B2

(12) United States Patent
Karasawa et al.

(10) Patent No.: US 8,434,859 B2
(45) Date of Patent: May 7, 2013

(54) CARTRIDGE

(75) Inventors: Masahiro Karasawa, Matsumoto (JP); Yuji Aoki, Matsumoto (JP); Hiroshi Satoh, Nirasaki (JP); Masaru Takahashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/330,013

(22) Filed: Dec. 19, 2011

(65) Prior Publication Data

US 2012/0200646 A1 Aug. 9, 2012

(30) Foreign Application Priority Data

Dec. 22, 2010 (JP) ..... 2010-285972

(51) Int. Cl.
*B41J 2/175* (2006.01)
*B41J 2/14* (2006.01)

(52) U.S. Cl.
USPC ..... 347/86; 347/49

(58) Field of Classification Search ..... 347/49, 347/85, 86, 87
See application file for complete search history.

(56) References Cited

U.S. PATENT DOCUMENTS

| | | | | |
|---|---|---|---|---|
| 5,221,935 | A * | 6/1993 | Uzita | 347/36 |
| 5,359,357 | A * | 10/1994 | Takagi et al. | 347/49 |
| 5,523,780 | A * | 6/1996 | Hirosawa et al. | 347/86 |
| 6,832,830 | B2 * | 12/2004 | Seino et al. | 347/86 |
| 6,834,945 | B2 * | 12/2004 | Ishizawa et al. | 347/86 |
| 7,950,789 | B2 * | 5/2011 | Matsumoto et al. | 347/86 |
| 7,954,931 | B2 | 6/2011 | Shimizu et al. | |
| 8,091,995 | B2 * | 1/2012 | Shimizu et al. | 347/86 |
| 2007/0243104 | A1 | 10/2007 | Aoki et al. | |
| 2008/0136878 | A1 | 6/2008 | Nozawa et al. | |
| 2010/0225704 | A1 | 9/2010 | Aoki et al. | |

FOREIGN PATENT DOCUMENTS

| | | | |
|---|---|---|---|
| JP | 2007-136807 | A | 6/2007 |
| JP | 2007-307894 | | 11/2007 |
| JP | 2008-036984 | A | 2/2008 |
| JP | 2008-137376 | A | 6/2008 |
| JP | 2008-273173 | A | 11/2008 |
| JP | 2010-208038 | A | 9/2010 |

* cited by examiner

*Primary Examiner* — Anh T. N. Vo
(74) *Attorney, Agent, or Firm* — Stroock & Stroock & Lavan LLP

(57) ABSTRACT

A cartridge includes a casing, a printing material containing portion, a printing material flow path and first and second insertion holes formed in a front face of the casing. A rod used for detection of the out-of-printing material state is inserted into the first insertion hole, and a printing material supply tube is inserted into the second insertion hole. The first insertion hole is located on the front face at a middle position between a first side face and a second side face of the casing.

13 Claims, 18 Drawing Sheets

1

7X-7X PARTIAL CROSS SECTION 7Z-7Z PARTIAL CROSS SECTION

CARTRIDGE

TECHNICAL FIELD

The present invention relates to a cartridge configured to contain printing material.

RELATED ART

A printer as one typical example of printing device is configured to eject ink from a print head onto a record subject (e.g., printing paper) for printing. One known method of ink supply to the print head uses ink cartridges containing ink (hereinafter simply called "cartridges"). Operating the print head with no supply of ink from the cartridge to the print head may damage the print head or cause various other troubles. In order to prevent such problem, detection means for detecting that the cartridge has no ink or little ink is provided on the cartridge or the printer (for example, PTL1 and PTL2). The state where the cartridge has no ink or little ink is herein called "out-of-ink state".

JP-A-2008-270750 is a first example of related art (also called "PTL1"). JP-A-2007-136807 is a second example of related art (also called "PTL2").

SUMMARY

Technical Problem

PTL1 discloses a system using piezoelectric detection means to detect the out-of-ink state. This system detects a change in volume of a detection chamber provided in the cartridge with the piezoelectric detection means, so as to detect the out-of-ink state. The system of PTL1, however, requires the cartridge to have power supply means to the piezoelectric detection means and electrical conduction means (e.g., wiring or electrode terminals) to allow signal transmission between the piezoelectric detection means and the printer. This complicates the structure of the cartridge, which may lead to size expansion of the cartridge and increase in manufacturing cost of the cartridge.

PTL2 discloses a system using an optical detection mechanism to detect the out-of-ink state. This system provides a structure having a positional change with a change in volume of a sub-tank and detects a displacement of the structure with an optical sensor, so as to detect the out-of-ink state. In the system of PTL2, however, deviation of the positional relationship among the sub-tank, the structure and the optical sensor from the designed accurate positional relationship may result in poor detection of the out-of-ink state.

These problems are not characteristic of the cartridge containing ink for printing but are also found in various printing devices configured to eject various liquids other than ink as the printing material and their cartridges.

Consequently, by taking into account the above problems, there is a need to prevent size expansion of the cartridge and the printing device. There is also a need to enable positioning of the cartridge relative to the cartridge mounting structure of the printing device with high accuracy. There is further a need to accurately detect the out-of-printing material state.

This application claims priority to Japanese Patent Application No. 2010-285972, the entire contents of which are incorporated by reference herein.

Solution to Problem

In order to achieve at least part of the foregoing, the present invention provides various aspects and embodiments described below.

First Aspect

A cartridge adapted to be removably attached to a cartridge mounting structure comprising a printing material supply tube fixed to a device front wall member and having a central axis extended in a predetermined direction, a rod provided on the device side wall member and having an axis parallel to the central axis and movable in a direction of the axis, and a sensor configured to detect displacement of the rod, wherein three mutually orthogonal special axes are X axis, Y axis and Z axis, directions along the X axis, the Y axis and the Z axis are respectively X-axis direction, Y-axis direction and Z-axis direction, a negative Y-axis direction represents a direction in which the cartridge is inserted into the cartridge mounting structure, and a positive Y-axis direction represents a direction in which the cartridge is removed from the cartridge mounting structure, the cartridge comprising:

a casing including:

first two faces opposed to each other in the Y-axis direction, one of the first two faces being a front face having an substantially rectangular shape located on the negative Y-axis side and having a length in the Z-axis direction greater than a length in the X-axis direction, and an another one of the first two faces being a rear face located on the positive Y-axis side;

second two faces opposed to each other in the Z-axis direction and arranged to intersecting the front face and the rear face, one of the second two faces being a first side face located on a positive Z-axis side, and an another one of the second two faces being a second side face located on a negative Z-axis side; and third two faces opposed to each other in the X-axis direction and intersecting the front face, the rear face, the first side face and the second side face, one of the third two faces being a third side face located on a positive X-axis side, and an another one of the third two faces being a fourth side face located on a negative X-axis side;

a printing material containing portion provided inside the casing;

a first insertion hole formed in the front face and adapted to receive the rod, the first insertion hole is located on the front face at a middle position between the first side face and the second side face;

a second insertion hole formed in the front face and adapted to receive the printing material supply tube; and a printing material flow path provided inside the casing and having first and second ends, the first end being a printing material supply port adapted to receive the printing material supply tube therein and located at the second insertion hole, and the second end connected with the printing material containing portion.

According to the first aspect, the cartridge does not have any piezoelectric detection mechanism to detect that the cartridge has no printing material or little printing material (out-of-printing material state). The cartridge accordingly does not need to have the power supply means or the electrical conduction means (e.g., wiring or electrode terminals) for transmission of signals between the detection mechanism and a printer or printing device. This advantageously simplifies the structure of the cartridge and enables size reduction of the cartridge. This also reduces the manufacturing cost of the cartridge.

In the cartridge according to the first aspect, the first insertion hole is located on the front face at the middle position between the first side face and the second side face of the casing. Positioning of the cartridge is thus performed at the middle position along the longitudinal direction of the front face. If positioning of the cartridge is performed at a location closer to one end along the longitudinal direction of the front face of the casing, the positional misalignment is prevented only at the one end closer to the positioning location, while there may be a significant positional misalignment at the other end farther from the positioning location. In the cartridge according to the first aspect, however, positioning of the cartridge is performed at the middle position along the longitudinal direction of the front face, so as to prevent the positional misalignment at both ends along the longitudinal direction almost equivalently. This enables the cartridge to be positioned relative to the cartridge mounting structure with high accuracy and high efficiency.

The "middle position" in the wording of "middle position between the first side face and the second side face" or "middle position between the first device side wall member and the second side wall member" may not be the exactly middle position but may be substantially middle position with no substantial bias to either of the first and second side faces. For example, the "middle position" may include the position slightly deviated from the center position between the first side face and the second side face in the Z-axis direction. More specifically, the "middle position" may include the position where the central axis of the first insertion hole is within a range of 10% from the center position along the distance between the first side face and the second side face in the Z-axis direction. In order to locate the central axis of the first insertion hole at the middle position as exactly as possible, it is preferable that the "middle position" includes the position where the central axis of the first insertion hole is within a range of 7.5% from the center position along the distance between the first side face and the second side face in the Z-axis direction.

Second Aspect

The cartridge according to the first aspect, wherein the printing material flow path has a detection chamber provided between the first and second end, the lever member configured to vary volume with a change in internal pressure, and a lever member configured to be displaced with a variation in volume of the detection chamber, the lever member arranged to abut an apex of the rod and thereby moving the rod in the axial direction.

In the cartridge according to the second aspect, the rod used for detection of the out-of-printing material state is inserted into the first insertion hole, so that positioning of the cartridge relative to the cartridge mounting structure is performed at the middle position along the longitudinal direction on the front face of the casing. This effectively prevents the positional misalignment between the cartridge and the rod and ensures accurate detection of the out-of-printing material state. The rod used for detection of the out-of-printing material state is also used for positioning of the cartridge relative to the cartridge mounting structure. This does not require any additional member for positioning and reduces the total number of parts, thus enabling size reduction of the cartridge and size reduction of the printing device, to which the cartridge is attached.

Third Aspect

The cartridge according to either one of the first aspect and the second aspect, wherein the first insertion hole is further adapted to receive a rod cover arranged to surrounding periphery of the rod.

The cartridge according to the second third aspect effectively prevents the rod from coming into contact with the wall member surrounding the first insertion hole and ensures smooth movement of the rod with a change in volume of the detection chamber, thus enabling detection of the out-of-printing material state with high accuracy.

Fourth Aspect

The cartridge according to any one of the first aspect to the third aspect, wherein the casing further comprising:

a protective case having an opening on the negative Y-axis side and accommodating the printing material containing portion therein; and a cap provided on the negative Y-axis side of the casing and attached to the protective case to close the opening of the protective case, wherein the second insertion hole and the first insertion hole are provided in the cap.

In the cartridge according to the fourth aspect, the casing includes the protective case and the cap, and the second insertion hole and the first insertion hole are provided on the cap. The side of the protective case accommodating the printing material containing portion has the greater total weight than the side of the cap. Continuously forming the side face of the casing from the front face (negative Y-axis end) to the rear face (positive Y-axis end) may tilt the cartridge with the rear face lower than the front face. When the protective case accommodating the printing material containing portion and the cap are provided as discrete members, a clearance between the cap and the protective case enables the protective case to be slightly moved relative to the cap. Even when the printing material containing portion has a relatively large weight, only the protective case is slightly tilted, but the cap is kept in the proper attitude without any tilting. This structure advantageously reduces the possibility that the positions of the second insertion hole and the first insertion hole formed in the cap relative to the cartridge mounting structure are deviated from the designed correct positions in the attached state of the cartridge to the cartridge mounting structure.

Fifth Aspect

The cartridge according to the fourth aspect, further comprising:

cartridge-side terminals adapted to contact with device-side terminals provided on the cartridge mounting structure in an attached state of the cartridge to the cartridge mounting structure, wherein the cartridge-side terminals are provided on the cap.

In the cartridge according to fifth aspect, the cartridge-side terminals are provided on the cap with the less possibility of deviation from the correct position. This ensures stable electrical connection between the cartridge-side terminals and the device-side terminals in the attached state.

Sixth Aspect

The cartridge according to either one of the fourth aspect and the fifth aspect, wherein the cap has a first side face forming a part of the first side face of the casing and a second side face forming a part of the second side face of the casing, a first projection protruded in the positive Z-axis direction is provided on the first side face of the cap, the first projection is adapted to be guided by a first rail provided on a first device side wall member, a second projection protruded in a negative Z-axis direction is provided on the second side face of the cap, the second projection is adapted to be guided by a second rail provided on a second device side wall member extended in the Y-axis direction and having a different length in the X-axis direction from the first rail, and the first projection and the second projection have different lengths in the X-axis direction.

The cartridge according to the sixth aspect has the first projection and the second projection having different lengths in the X-axis direction. The length of the first rail in the X-axis direction corresponds to the length of the first projection in the X-axis direction, while the length of the second rail in the X-axis direction corresponds to the length of the second projection in the X-axis direction. This structure effectively prevents attachment of the cartridge in the wrong attitude, i.e., upside down of the first side face and the second side face, to the cartridge mounting structure.

Seventh Aspect

The cartridge according to the sixth aspect, wherein the protective case has a first side face forming another part of the first side face of the casing and a second side face forming another part of the second side face of the casing, a first case-side projection protruded in the positive Z-axis direction is provided on the first side face of the protective case, wherein the first case-side projection is adapted to be guided by the first rail, a second case-side projection protruded in the negative Z-axis direction is provided on the second side face of the protective case, wherein the second case-side projection is adapted to be guided by the second rail, and one part located on the positive Y-axis side of at least one of the first case-side projection and the second case-side projection has a protrusion protruded in the X-axis direction, such that the one part to has a greater length in the X-axis direction than a length in the X-axis direction of another part located on the negative Y-axis side of the one part.

In the cartridge according to the seventh aspect, at least one of the first case-side projection and the second case-side projection has one part having the greater length in the X-axis direction than the length in the X-axis direction of the other part. A certain clearance is accordingly provided between the projection of the cartridge and the corresponding rail of the cartridge mounting structure. For attachment of the cartridge to the cartridge mounting structure, this allows smoother insertion of the cartridge into the cartridge mounting structure. The one part having the greater length in the X-axis direction, in cooperation with the corresponding rail, effectively restricts the motion of the positive Y-axis side of the cartridge in the X-axis direction after attachment of the cartridge to the cartridge mounting structure.

Eighth Aspect

The cartridge according to any one of the first aspect to the seventh aspect, wherein the first insertion hole has one open end on the negative Y-axis side, the open end is provided at a position to receive the rod before the printing material supply port receiving the printing material supply tube.

In the cartridge according to the eighth aspect, the printing material supply tube is connected with the printing material supply tube, after the cartridge is guided to the correct position in the cartridge mounting structure by means of the rod. This structure effectively prevents the apex of the printing material supply tube from hitting against the different position of the cartridge from the printing material supply port and thereby protects the printing material supply tube from being damaged. This structure also reduces the positional misalignment between the central axis of the printing material supply tube and the central axis of the printing material supply port and does not make any significant clearance between the printing material supply port and the periphery of the printing material supply tube. This advantageously reduces the possibility of leakage of the printing material from such clearance.

Ninth Aspect

The cartridge according to the eighth aspect, wherein the one open end of the first insertion hole is located on the negative Y-axis side to the printing material supply port.

In the cartridge according to the ninth aspect, even when the positive Y-axis apex of the printing material supply tube fixed to the device front wall member and the positive Y-axis apex of the rod are located at an identical position in the Y-axis direction, the predetermined positional relationship between the printing material supply port and the one open end of the first insertion hole allows insertion of the rod into the first insertion hole, prior to insertion of the printing material supply tube into the printing material supply port.

Tenth Aspect

The cartridge according to either one of the eighth aspect to the ninth aspect, further comprising:

a cartridge side identification member configured to identify type of the cartridge, based on whether the cartridge-side identification member is fit with a device side identification member provided on the cartridge mounting structure, wherein the cartridge side identification member is configured to fit with the device-side identification member after the first insertion hole receiving the rod and before the printing material supply port receiving the printing material supply tube.

In the cartridge according to the tenth aspect, when the wrong type of the cartridge different from the correct type of the cartridge is inserted into the cartridge mounting structure, the cartridge-side identification member burns into the device-side identification member, so as to interfere with further insertion of the wrong type of the cartridge. This structure advantageously reduces the possibility that the wrong type of the cartridge is connected with the printing material supply tube. The fit between the device-side identification member and the cartridge-side identification member starts after insertion of the rod into the first insertion hole for positioning the cartridge relative to the cartridge mounting structure. This effectively prevents the positional misalignment between the device-side identification member and the cartridge-side identification member. This structure reduces the possibility of bad fit that the cartridge-side identification member hits against the device-side identification member when the correct type of the cartridge is inserted into the cartridge mounting structure. This structure, on the other hand, causes the cartridge-side identification member to hit against the device-side identification member when the wrong type of the cartridge is inserted into the cartridge mounting structure, so as to interfere with further insertion of the cartridge. This structure advantageously reduces the possibility that the wrong type of the cartridge is connected with the printing material supply tube.

Eleventh Aspect

The cartridge according to the tenth aspect, wherein an end of the cartridge-side identification member in the negative Y-axis direction is provided on the positive Y-axis side to the one open end of the first insertion hole and on the negative Y-axis side to the printing material supply port.

In the cartridge according to the eleventh aspect, even when the positive Y-axis apex of the printing material supply tube, the positive Y-axis apex of the rod and the positive Y-axis end of the device-side identification member are located at an identical position in the Y-axis direction, the predetermined positional relationship among the printing material supply port, the one open end of the first insertion hole and the end of the cartridge-side identification member in the negative Y-axis direction allows the fit between the cartridge-side identification member and the device-side identification member after insertion of the rod into the first insertion hole but before insertion of the printing material supply tube into the printing material supply port.

In the cartridge according to either one of the tenth aspect and the eleventh aspect, it is preferable that the cartridge-side identification member has at least one rib and is formed in a different pattern, which is specified by the number and the positions of ribs, corresponding to the type of the cartridge.

The cartridge-side identification member is simply formed by the pattern of ribs.

Twelfth Aspect

The cartridge according to any one of the first aspect to the eleventh aspect, wherein the first insertion hole has a predetermined length in the Y-axis direction, and the one open end on the negative Y-axis side of the first insertion hole has a smaller area than an area of an another open end on the positive Y-axis side of the first insertion hole.

In the cartridge according to the twelfth aspect, the one open end on the negative Y-axis side of the first insertion hole to receive the rod first is wider than the other open end on the positive Y-axis side. This structure enables the rod to readily enter the first insertion hole through the wider one open end on the negative Y-axis side, and insertion of the rod into the other open end on the positive Y-axis side ensures accurate positioning of the cartridge to the cartridge mounting structure Thirteenth Aspect The cartridge according to the twelfth aspect, wherein the first insertion hole includes one side portion extending from a joint to the one open end on the negative Y-axis side and an another side portion extending from the joint to the another open end on the positive Y-axis side, the one side portion is formed in a truncated cone shape having a cross section in the shape of a circle parallel to the X axis and the Z axis, the another side portion is formed in a columnar shape having a cross section parallel to the X axis and the Z axis, which is defined by a combination of a pair of straight lines opposed to each other in the Z-axis direction and a pair of arcs opposed to each other in the X-axis direction, and at the joint, a distance between the pair of straight lines defining a part of the cross section of the another side portion is smaller than a diameter of the circle defining the cross section of the one side portion, and a diameter of the pair of arcs defining another part of the cross section of the another side portion is equal to the diameter of the circle defining the cross section of the one side portion.

In the cartridge according to the thirteenth aspect, the area of the cross section of the one side portion gradually decreases from the one open end on the negative Y-axis side toward the joint. The shape of the cross section changes to have the smaller length in the Z-axis direction but keep the same length in the X-axis direction at the joint or at the entrance of the other end portion. The shape and the area of the cross section do not change between the joint and the other open end on the positive Y-axis side. This structure enables the rod to be smoothly guided from the one side portion to the other side portion. The other side portion has a clearance between the rod and the first insertion hole in the X-axis direction in order to smoothly guide the rod to the other open end on the positive Y-axis side, while stabilizing the position of the rod in the Z-axis direction to enable the cartridge to be accurately positioned relative to the cartridge mounting structure.

The present invention may be implemented by diversity of aspects and embodiments in addition to the various aspect of the cartridge described above, for example, a method of manufacturing the cartridge, a printing device, and a printing material supply system including the cartridge and the printing device.

DESCRIPTION OF EMBODIMENTS

Some embodiments of the invention are described below with reference to the accompanied drawings:

A. First Embodiment

B. Modifications

A. First Embodiment

A-1. General Configuration of Printing Material Supply System

Figure 1:
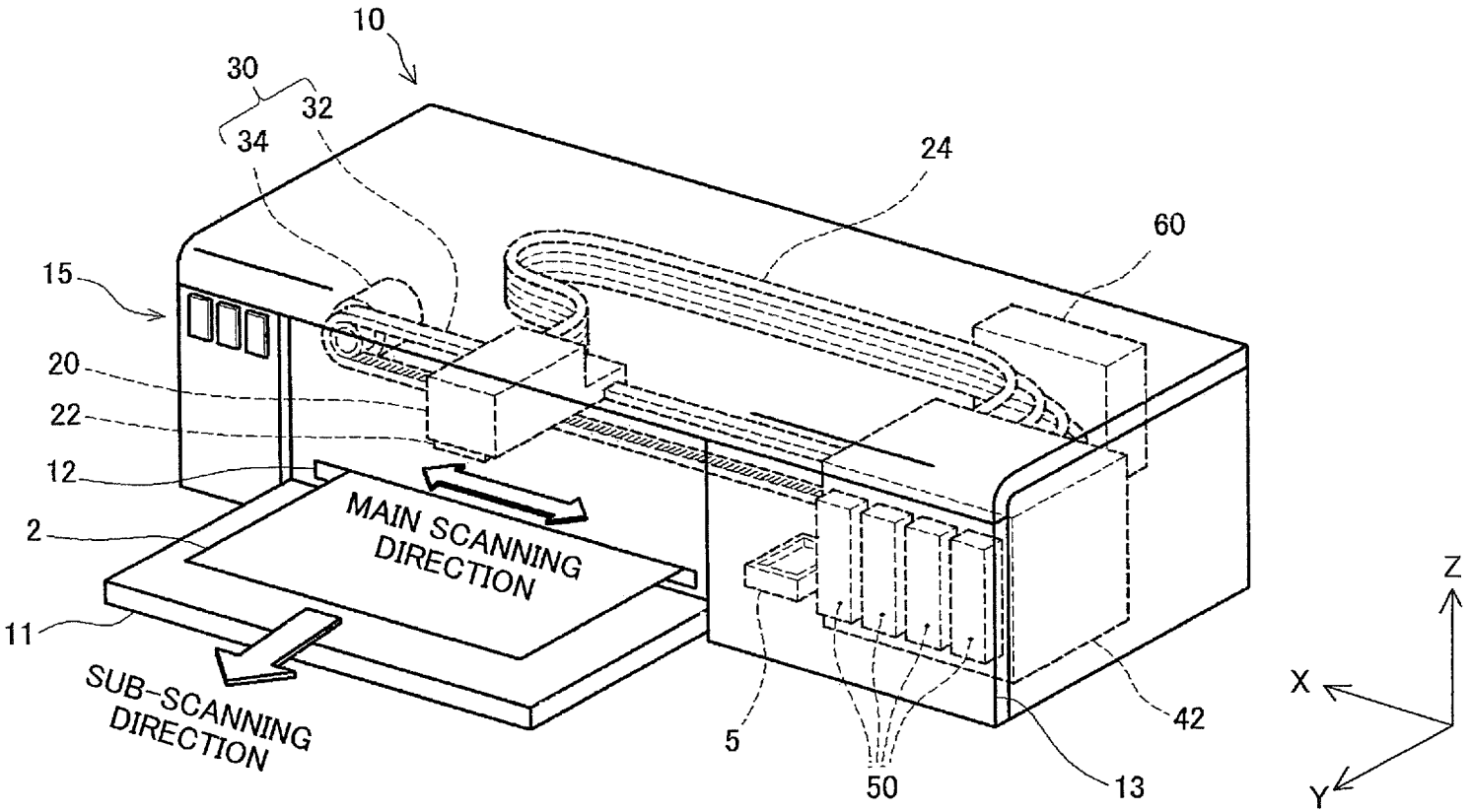
FIG. 1 is a perspective view illustrating the configuration of a printing material supply system.

FIG. 1 is a perspective view illustrating the configuration of a printing material supply system 1. Mutually orthogonal XYZ axes are shown in FIG. 1. In the subsequent drawings, the XYZ axes are shown as needed basis. The XYZ axes in the other drawing correspond to the directions of the XYZ axes in FIG. 1. The printing material supply system 1 includes a printer 10 serving as a printing device and cartridges 50.

According to this embodiment, the printer 10 is an inkjet printer configured to eject ink from a head 22. Each of the cartridges 50 is configured to contain ink as printing material. The ink contained in the cartridge 50 flows through a tube 24 and is supplied to the head 22 on a carriage 20. The printer 10 mainly includes a cartridge mounting structure 42, a controller 60, the carriage 20, the head 22 and a driving mechanism 30. The printer 10 also has operation buttons 15 pressed by the user for various operations of the printer 10.

The cartridges 50 are removably attached to the cartridge mounting structure 42. According to this embodiment, four cartridges 50 respectively containing four different color inks (i.e., black, yellow, magenta and cyan) are attached to the cartridge mounting structure 42. An access cover 13 is provided on the front face (i.e., the face on the positive Y-axis side) of the printer 10 according to the embodiment. When the user pulls down (i.e., in the positive Y-axis direction) the positive Z-axis side of the access cover 13, the user can access the cartridge mounting structure 42 to attach or detach the cartridges 50. In the attached state of the cartridge 50 to the cartridge mounting structure 42, ink can be supplied through the tube 24 to the head 22 provided on the carriage 20. According to this embodiment, a pump mechanism (not shown) of the printer 10 sucks the ink contained in the cartridge 50 to supply the ink to the head 22. The tube 24 is provided for each type of ink (i.e., each of the plurality of different ink colors).

Ejection nozzles are provided for each type of ink on the head 22. Ink is ejected from the ejection nozzles on the head 22 onto printing paper 2 to print data, such as character strings and images. The process of attachment of the cartridge 50 to the cartridge mounting structure 42 and the detailed structures of the cartridge 50 and the cartridge mounting structure 42 will be described later. According to this embodiment, the printer 10 has the cartridge mounting structure 42 that does not move in conjunction with the carriage 20 and is accordingly the "off-carriage" type. The present invention is also applicable to the "on-carriage" type of printers, wherein the cartridge mounting structure 42 is provided on the carriage 20 and is moved along with the carriage 20.

The controller 60 serves to control the respective parts of the printer 10 and to receive and send signals from and to the respective cartridges 50. The carriage 20 moves the head relative to the printing paper 2.

The driving mechanism 30 moves back and forth the carriage 20 in response to control signals from the controller 60. The driving mechanism 30 includes a timing belt 32 and a drive motor 34. Transmitting the power of the drive motor 34 via the timing belt 32 to the carriage 20 moves the carriage 20 back and forth in a main scanning direction (X-axis direction). The printer 10 has a feeding mechanism to feed the printing paper 2 in a sub-scanning direction (Y-axis direction). The printing paper 2 moves in the sub-scanning direction by the feeding mechanism during printing, and the printing paper 2 after printing exits through an opening slot 12 onto a front cover 11.

An area called home position is set at a specific position out of a printable area along the main scanning direction of the carriage 20. A maintenance mechanism to ensure normal printing is provided at the home position. The maintenance mechanism includes a cap member 5 which is pressed against a surface with nozzles (nozzle surface) on the bottom side of the head 22 (i.e., the side facing the printing paper 2) to define an enclosed space surrounding the ejection nozzles, a lift mechanism (not shown) which lifts up and down the cap member 5 to be pressed against the nozzle surface of the head 22, and a suction pump (not shown) which applies a negative pressure to the enclosed space defined by pressing the cap member 5 against the nozzle surface of the head 22.

According to this embodiment, in the use state or use attitude of the printing material supply system 1, the Y axis represents the axis along the sub-scanning direction (front-rear direction), in which the printing paper 2 is fed, the Z axis represents the axis along the direction of gravity (vertical direction), and the X axis represents the axis along the main scanning direction or the moving direction of the carriage 20 (left-right direction). According to this embodiment, the positive Y-axis direction represents the sub-scanning direction (forward direction), the negative Y-axis direction represents its reverse direction (backward direction), the positive Z-axis direction represents the direction going from the bottom to the top along the direction of gravity (upward direction), and the negative Z-axis direction represents its reverse direction (downward direction). The positive X-axis direction represents the direction going from the right side to the left side, when the printing material supply system 1 is viewed from the front side (positive Y-axis side), and the negative X-axis direction represents its reverse direction. According to this embodiment, the plurality of cartridges 50 are arrayed in the X-axis direction.

A-2. Detailed Structure of Cartridge Mounting Structure

Figure 2:
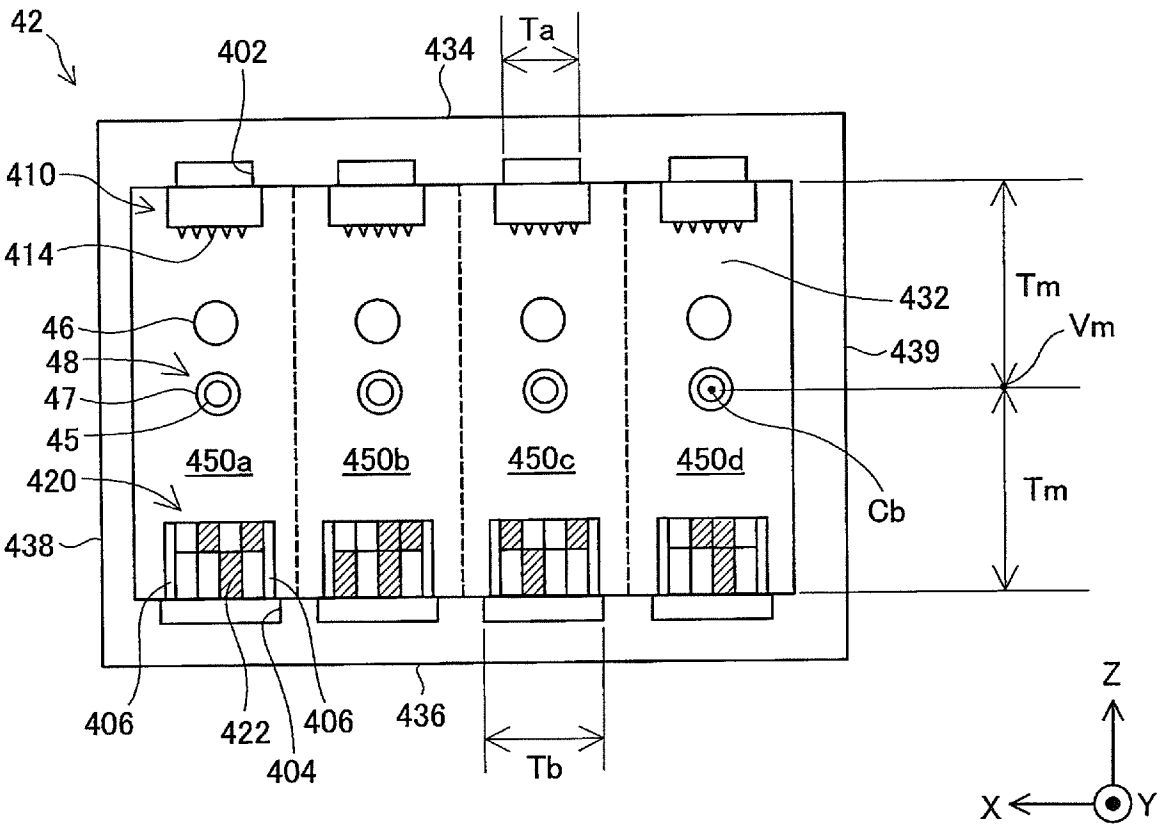
FIG. 2 is a front view of a cartridge mounting structure.
Figure 3:
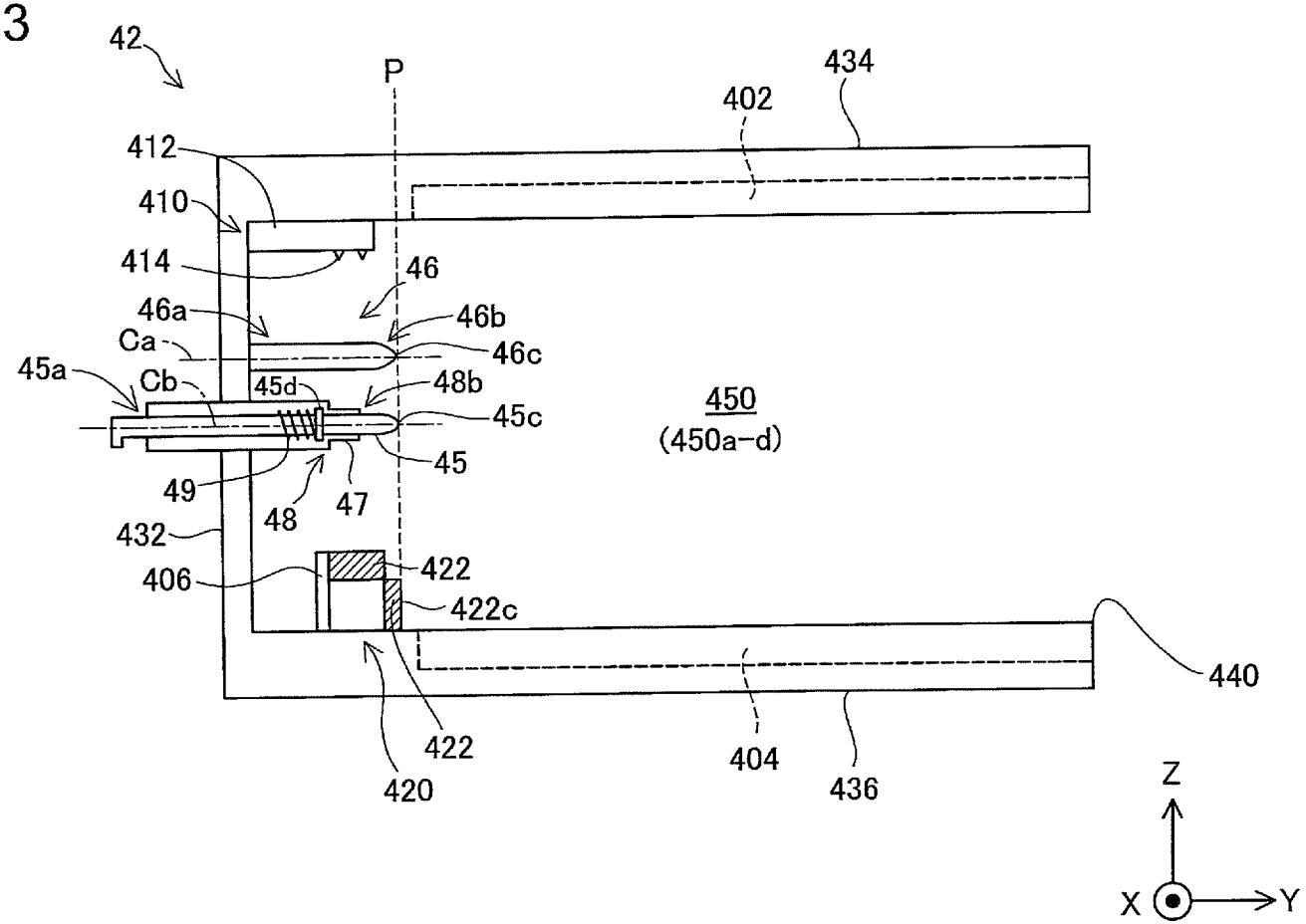
FIG. 3 is a side view of the cartridge mounting structure.
Figure 4:
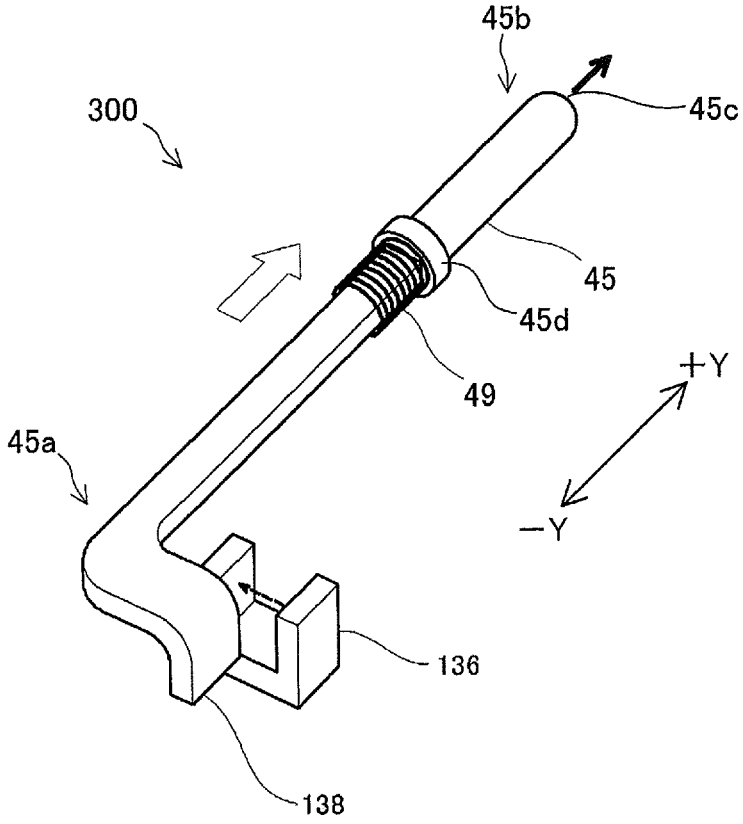
FIG. 4 illustrates the method of detecting the out-of-ink state.

FIG. 2 is a front view of the cartridge mounting structure 42. FIG. 3 is a side view of the cartridge mounting structure 42. FIG. 4 illustrates a method of detecting out-of-ink. A rod cover (described later) is omitted from the illustration of FIG. 4. The detailed structure of the cartridge mounting structure 42 is described with reference to FIGS. 2 to 4. The X-axis direction, the Z-axis direction and the Y-axis direction are also expressed as the width direction, the height direction and the length direction of the cartridge mounting structure 42.

As shown in FIGS. 2 and 3, the cartridge mounting structure 42 has the outer shape of an approximate rectangular parallelepiped. The cartridge mounting structure 42 includes a device front wall member 432, a first device side wall member 434 provided in the direction intersecting the device front wall member 432, and a second device side wall member 436 provided in the direction intersecting the device front wall member 432 and opposed to the first device side wall member 434. The cartridge mounting structure 42 further includes a third device side wall member 438 provided in the direction intersecting the device front wall member 432, the first device side wall member 434 and the second device side wall member 436, and a fourth device side wall member 439 provided in the direction intersecting the device front wall member 432, the first device side wall member 434 and the second device side wall member 436 and opposed to the third device side wall member 438. The respective wall members 432, 434, 436, 438 and 439 define a space 450 to receive the cartridges 50. The space 450 is parted into four chambers 450*a* to 450*d* to individually receive the four cartridges 50. The cartridge mounting structure 42 also has an opening 440 opposed to the device front wall member 432 across the space 450 (FIG. 3). Each of the cartridges 50 passes through the opening 440 to be attached to or detached from the cartridge mounting structure 42. The direction of insertion of the cartridge 50 into the cartridge mounting structure 42 is the negative Y-axis direction, while the direction of removal of the cartridge 50 from the cartridge mounting structure 42 is the positive Y-axis direction.

In the specification hereof, the term "intersect" or "cross" means one of the state that two elements actually cross each other, the state that an extension of one element intersects the other element, and the state that extensions of two elements cross each other.

The positional relationship of the respective wall members is further described. The device front wall member 432 is located on the negative Y-axis side of the space 450. According to this embodiment, the device front wall member 432 is erected relative to the horizontal plane (i.e., the plane parallel to the X axis and the Y axis). The first device side wall member 434 is located on the positive Z-axis side of the space 450. According to this embodiment, the first device side wall member 434 is the horizontal plane. The second device side wall member 436 is located on the negative Z-axis side of the space 450. According to this embodiment, the second device side wall member 436 is the horizontal plane. The third device side wall member 438 is located on the positive X-axis side of the space 450. According to this embodiment, the third device side wall member 438 is erected relative to the horizontal plane. The fourth device side wall member 439 is located on the negative X-axis side of the space 450. According to this embodiment, the fourth device side wall member 439 is erected relative to the horizontal plane.

As shown in FIGS. 2 and 3, printing material supply tubes 46 and rods 45 are provided on the device front wall member 432. The printing material supply tube 46 and the rod 45 are arrayed in the Z-axis direction orthogonal to the Y-axis direction. The printing material supply tube 46 is provided on the positive Z-axis side of the rod 45. The direction going from the rod 45 to the printing material supply tube 46 along the Z axis is accordingly the positive Z-axis direction, and its reverse direction is the negative Z-axis direction. The printing material supply tube 46 and the rod 45 are protruded in the positive Y-axis direction to the same length from the device front wall member 432. In other words, an apex 46*c* of the printing material supply tube 46 and a positive Y-axis apex 45*c* of the rod 45 are located at an identical position P in the Y-axis direction. Rod covers 47 structured to cover the peripheries of the respective rods 45 and springs 49 are also provided on the device front wall member 432. The rod 45, the rod cover 47 and the spring 49 are collectively called a rod-shaped member 48.

The printing material supply tube 46 is connected with the cartridge 50 in the attached state of the cartridge 50 to the cartridge mounting structure 42. Therefore, ink is flowed through the printing material supply tube 46 to the printer 10. As shown in FIG. 3, the printing material supply tube 46 includes a base end 46*a* fastened to the device front wall member 432 and a peripheral end 46*b* connected with the cartridge 50. The printing material supply tube 46 also has a central axis Ca extended in the Y-axis direction. The direction going from the base end 46*a* to the peripheral end 46*b* along the Y axis is the positive Y-axis direction, and its reverse direction is the negative Y-axis direction.

The rod 45 is used to detect the out-of-ink state of the cartridge 50. The rod 45 has an axis Cb extended along the Y-axis direction. The rod 45 is movable along the direction of the axis Cb (Y-axis direction). The displacement of the rod 45 in the Y-axis direction is detected with a sensor. The position of the rod 45 in the Y-axis direction in the out-of-ink state where the cartridge 50 has little link is changed from the position of the rod 45 in the Y-axis direction in the state where ink remains in the cartridge 50. Detecting the displacement of the rod 45 accordingly detects the out-of-ink state. The "out-of-ink" state herein means not only the state where ink is completely used up but the state where a little amount of ink remains. The rod 45 is arranged to pass through the device front wall member 432. One portion of the rod 45 located on the positive Y-axis side of the device front wall member 432 is called positive Y-axis side portion 45*b*, whilst the other portion of the rod 45 located on the negative Y-axis side of the device front wall member 432 is called negative Y-axis side portion 45*a*. The rod cover 47 is a cylindrical member arranged to surround the periphery of the rod 45. The spring 49 is located between a spring bearing 45*d* provided on the positive Y-axis side portion 45*b* of the rod 45 and the device front wall member 432 to press the rod 45 in the positive Y-axis direction. The spring 49 is set around the periphery of the rod 45 and is covered by the rod cover 47. The following description of the rod 45 can be regarded as the description of the rod-shaped member 48.

The rod 45 is located on the device front wall member 432 at a middle position between the first device side wall member 434 and the second device side wall member 436. More specifically, the rod 45 is located in the Z-axis direction at the middle position of the line segment connecting the inner surface of the first device side wall member 434 with the inner surface of the second device side wall member 436. In other words, the central axis Cb of the rod 45 is arranged at the middle position in the Z-axis direction between the first device side wall member 434 and the second device side wall member 436. The "middle position" may not be the exactly middle position but may be substantially middle position with no substantial bias to either of the first and second device side wall members 434 and 436. For example, the "middle position" may include a range within 10% from a center position Vm along a distance in the Z-axis direction between the inner wall surfaces of the first device side wall member 434 and the second device side wall member 436. In order to locate the central axis Cb at the middle position as exactly as possible, it is preferable that the "middle position" includes a range within 7.5% from the center position Vm along the distance in the Z-axis direction between the inner wall surfaces of the first device side wall member 434 and the second device side wall member 436.

The method of detecting the displacement of the rod 45 is described with reference to FIG. 4, prior to the description of the other components. According to this embodiment, an optical detection mechanism 300 is used to detect the displacement of the rod 45. The detection mechanism 300 includes the rod 45, a light shield 138 and a sensor 136. The sensor 136 is provided on the negative Y-axis side of the device front wall member 432. The sensor 136 is, for example, a transmissive photosensor in a concave shape. The sensor 136 includes a light-emitting element and a light-receiving element (not shown) arranged to be opposed to each other. The arrow of broken line represents the direction of light transmission.

The light shield 138 is provided on a negative Y-axis end of the rod 45. When the rod 45 is moved toward the cartridge 50 (i.e., in the positive Y-axis direction) by the force of the spring 49, the light shield 138 is inserted between the light-emitting element and the light-receiving element of the sensor 136 to shield the light emitted from the light-emitting element. The light-receiving element of the sensor 136 then does not receive the light emitted from the light-emitting element and accordingly detects the change in position of the rod 45. The transmissive photosensor is used for the sensor 136 according to this embodiment. The sensor 136 is, however, not limited to the photosensor but may be any other means capable of detecting the displacement of the rod 45. For example, a detection piece in a shape like the light shield 138 may be used to turn on and off a mechanical switch and thereby detect the displacement of the rod 45. The displacement of the rod 45 may be detected by a detection mechanism other than the optical detection mechanism, for example, a mechanical detection mechanism or an electrical detection mechanism. The detection of the out-of-ink state in relation to the detection of the displacement of the rod 45 will be described later.

Referring back to FIGS. 2 and 3, the detailed structure of the cartridge mounting structure 42 is further discussed. The first device side wall member 434 has first rails 402 extended from its positive Y-axis end in the negative Y-axis direction. The first rails 402 are grooves formed in the first device side wall member 434. The second device side wall member 436 has second rails 404 extended from its positive Y-axis end in the negative Y-axis direction. The first rail 402 and the second rail 404 have different length or widths in the X-axis direction. According to this embodiment, the first rail 402 has a length Ta in the X-axis direction, which is less than a length Tb of the second rail 404 in the X-axis direction as shown in FIG. 2.

The cartridge mounting structure 42 also has contact mechanisms 410, device-side identification members 420 and restriction members 406. In the description hereinafter, the "device-side identification member 420" may simply be called "identification member 420". The contact mechanism 410 is provided at a corner where the first device side wall member 434 intersects the device front wall member 432. The contact mechanism 410 includes a plurality of device-side terminals 414 and a holder member 412 to hold the device-side terminals 414. The plurality of device-side terminals 414 are electrically connected with the controller 60 of the printer 10 (FIG. 1).

The identification members 420 are provided on the second device side wall member 436. The identification members 420 are used to identify whether the correct types of cartridges 50 are attached to the respective chambers 450*a* to 450*d* of the space 450. The identification members 420 are formed in different shapes corresponding to the ink colors contained in the cartridges 50 attached to the respective chambers 450*a* to 450*d*. More specifically, the identification member 420 has at least one rib 422 and is formed in a different pattern, which is specified by the number and the positions of the ribs 422, corresponding to the type of the cartridge 50 (ink color in this embodiment). In FIG. 2, rectangles of each identification member 420 represent the available positions of the ribs 422, and hatched rectangles represent the positions where the ribs 422 are actually placed. When the correct type of the cartridge 50 is inserted into each of the chambers 450*a* to 450*d* of the space 450, a cartridge-side identification member formed as a pattern of ribs on the cartridge 50 fits the identification member 420. Such fit enables the correct types of cartridges 50 to be attached to the respective chambers 450*a* to 450*d*. When the wrong type of the cartridge 50 is inserted into each of the chambers 450*a* to 450*d* of the space 450, the ribs of the cartridge-side identification member hit against the ribs 422 of the identification member 420 to interfere with attachment of the cartridge 50. Such hitting effectively prevents attachment of any wrong type of the cartridge 50 to the respective chambers 450*a* to 450*d*. A positive Y-axis end 422*c* of the identification member 420 is arranged at the same position P in the Y-axis direction as those of the apex 46*c* of the printing material supply tube 46 and the positive Y-axis apex 45*c* of the rod 45.

The restriction members 406 abut the cartridge 50 and reduce the possibility that the cartridge 50 is excessively pressed into the space 450. The restriction members 406 are arranged on both sides in the X-axis direction of the identification member 420. The restriction members 406 are extended from the second device side wall member 436 toward the first device side wall member 434.

A-3. Structure of Cartridge

A-3-1. Description on Primary Components of Cartridge

Figure 5:
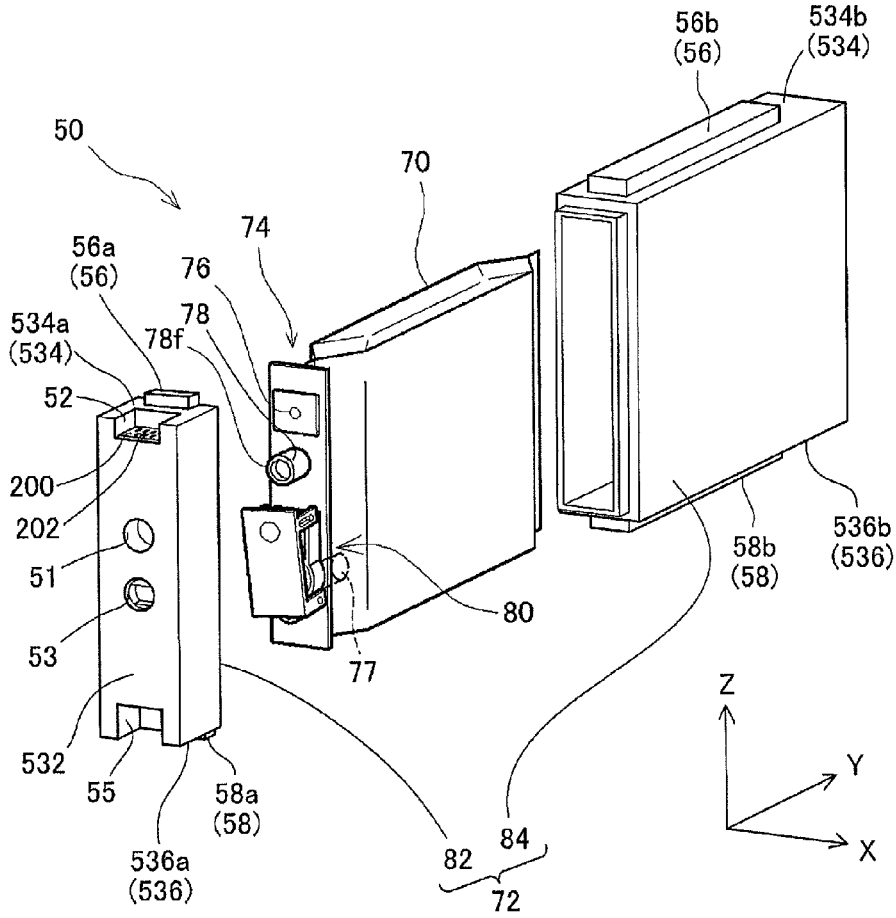
FIG. 5 is an exploded perspective view of a cartridge.
Figure 6:
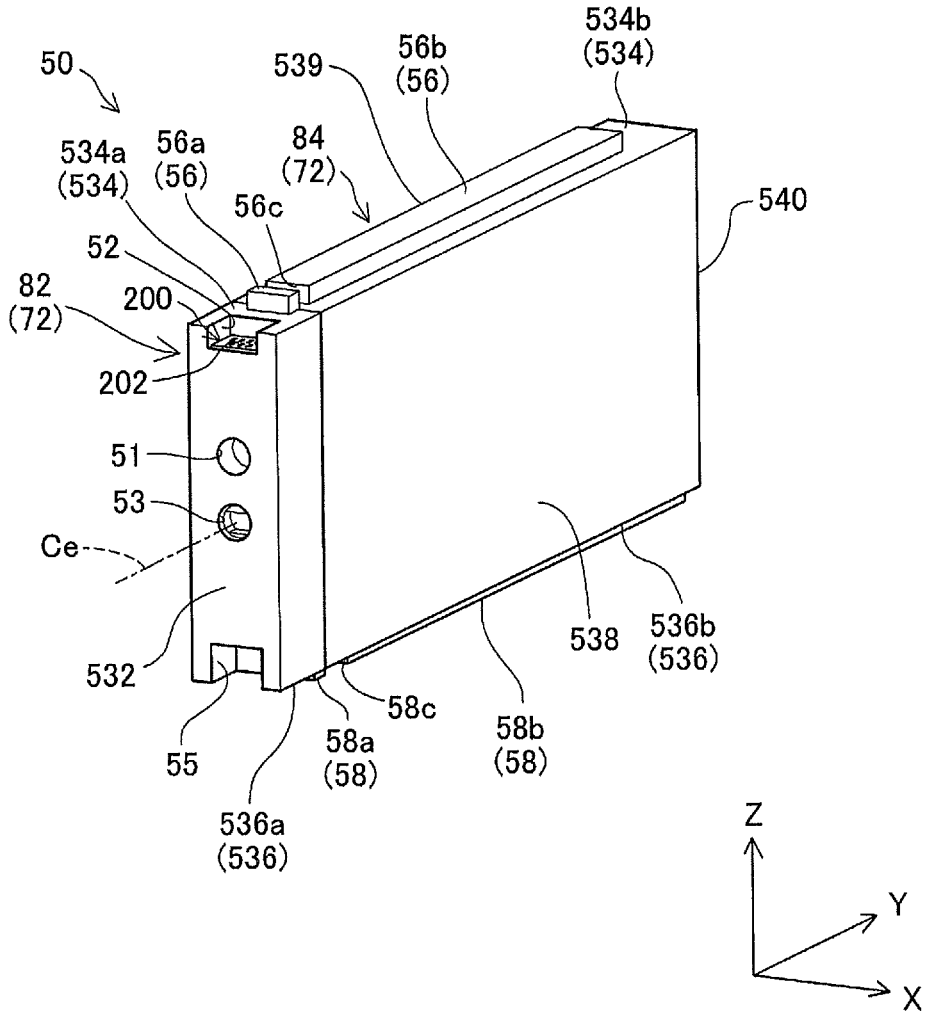
FIG. 6 is a perspective view illustrating the appearance of the cartridge.
Figure 7A:
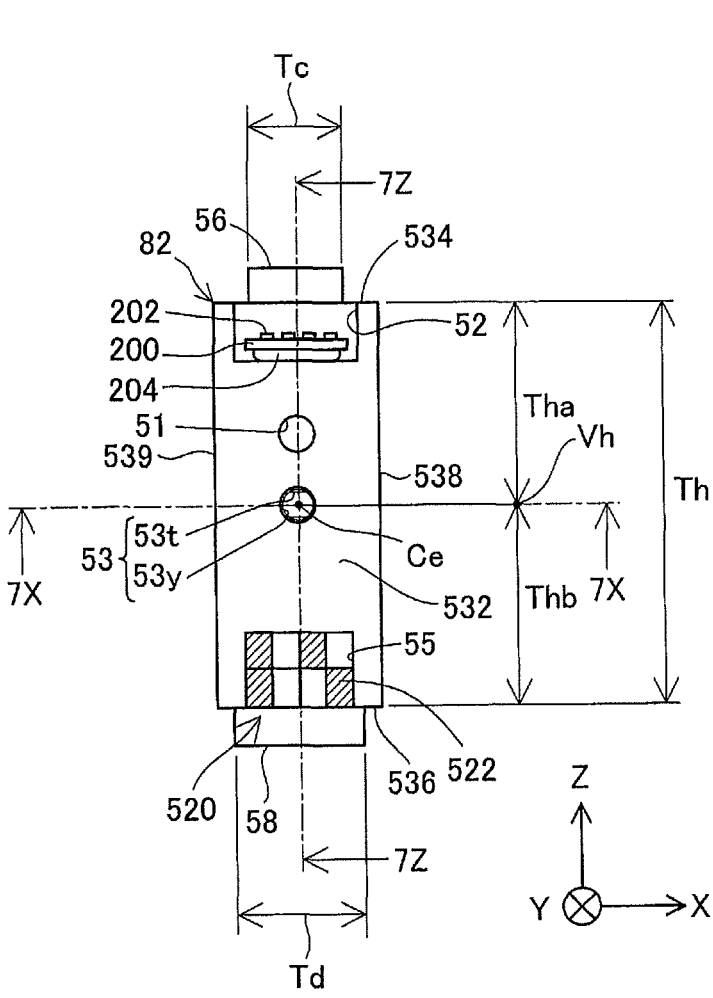
FIG. 7A is a front view of the cartridge.
Figure 7B:
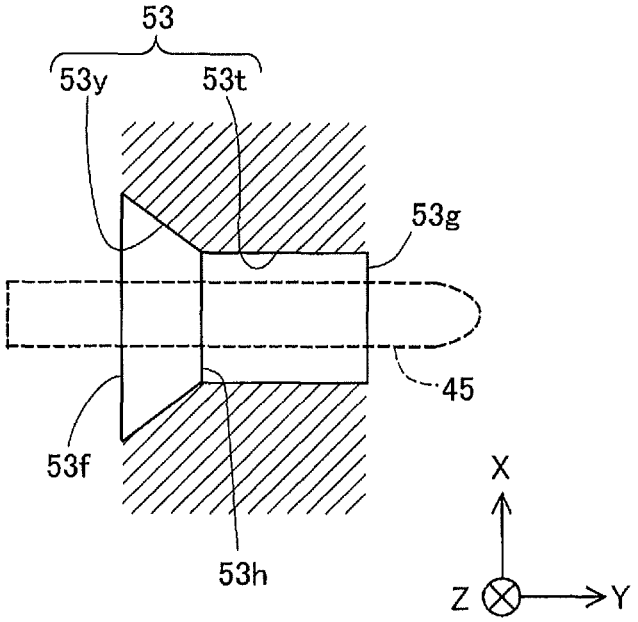
FIG. 7B shows part of a 7X-7X cross section of the cartridge in FIG. 7A, taken on a plane that is parallel to the X axis and the Y axis and includes a central axis Ce of a first insertion hole.
Figure 7C:
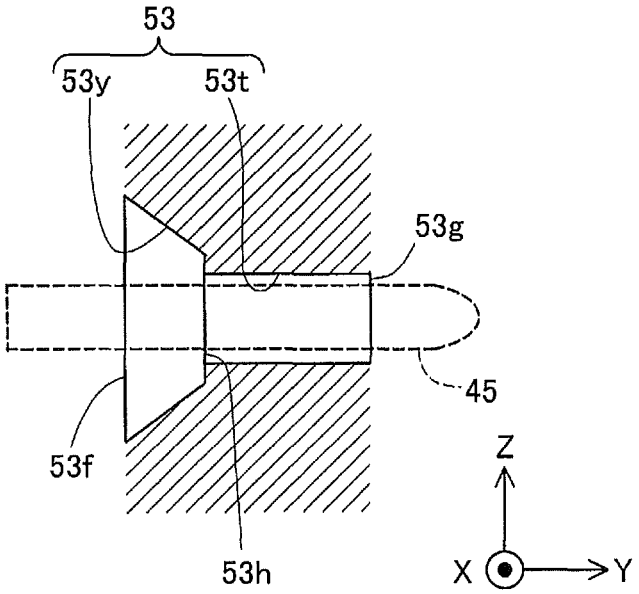
FIG. 7C shows part of a 7Z-7Z cross section of the cartridge in FIG. 7A, taken on a plane that is parallel to the Z axis and the Y axis and includes the central axis Ce of the first insertion hole.
Figure 7D:
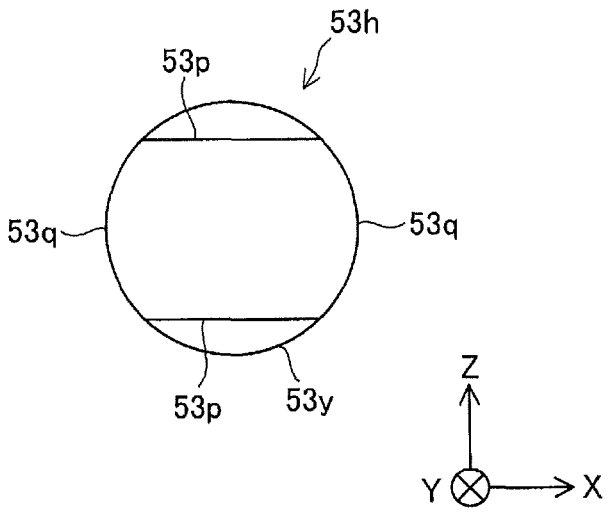
FIG. 7D illustrates a cross section of one side portion and the other side portion of the first insertion hole at a joint, taken on a plane parallel to the Z axis and the X axis.
Figure 8:
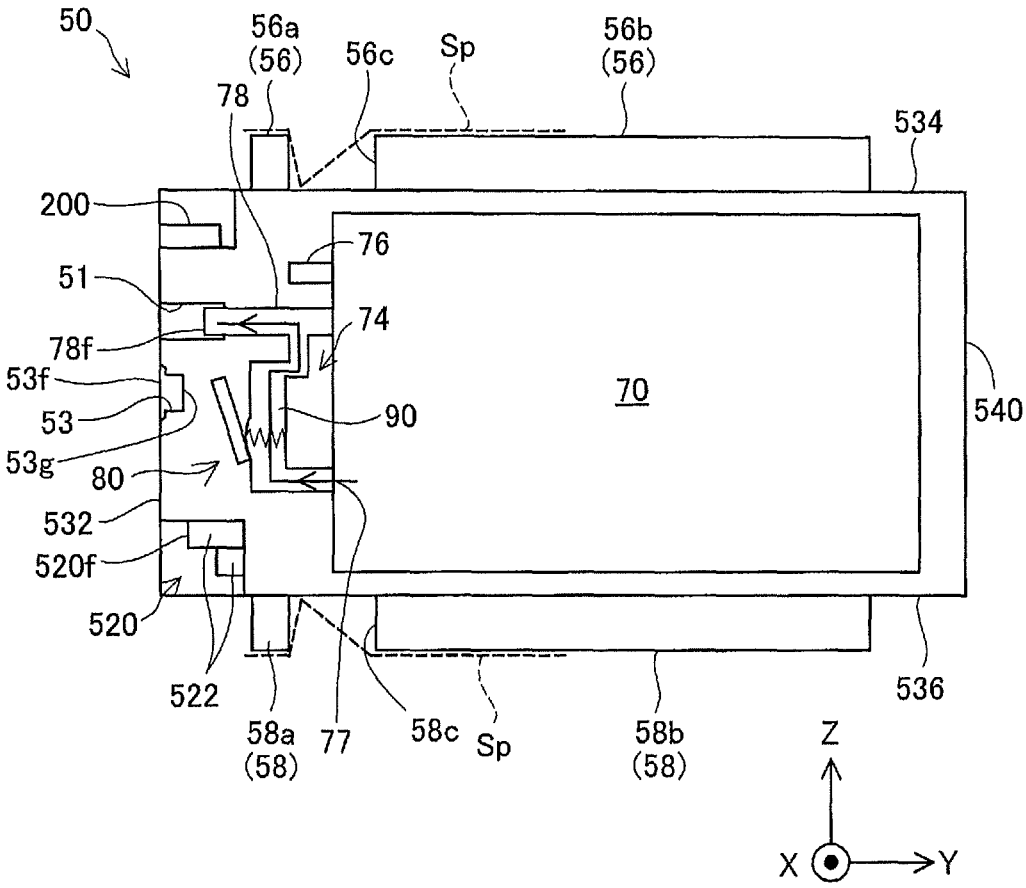
FIG. 8 illustrates the internal structure of the cartridge.
Figure 9A:
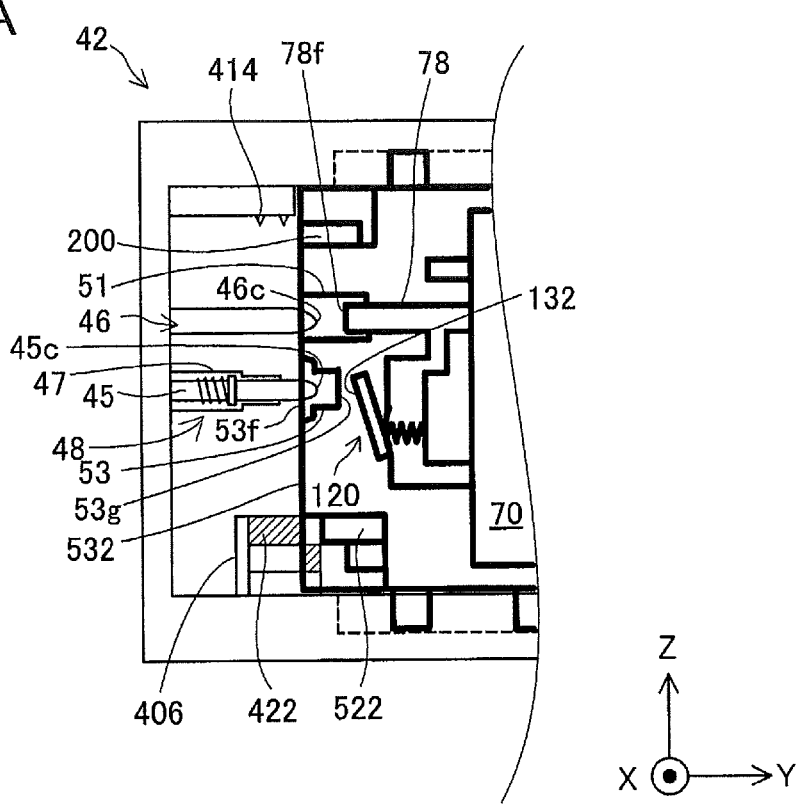
FIG. 9A is a first view schematically illustrating attachment of the cartridge to the cartridge mounting structure.
Figure 9B:
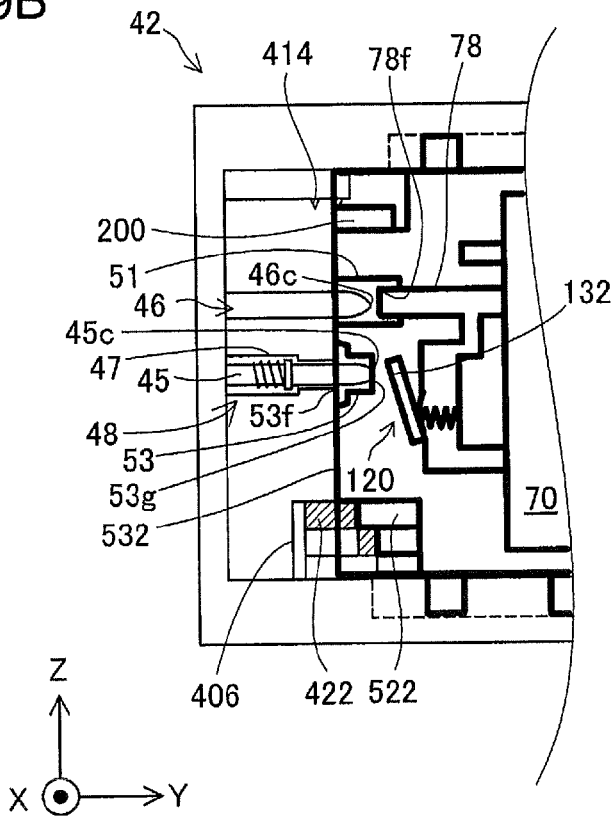
FIG. 9B is a second view schematically illustrating attachment of the cartridge to the cartridge mounting structure.
Figure 9C:
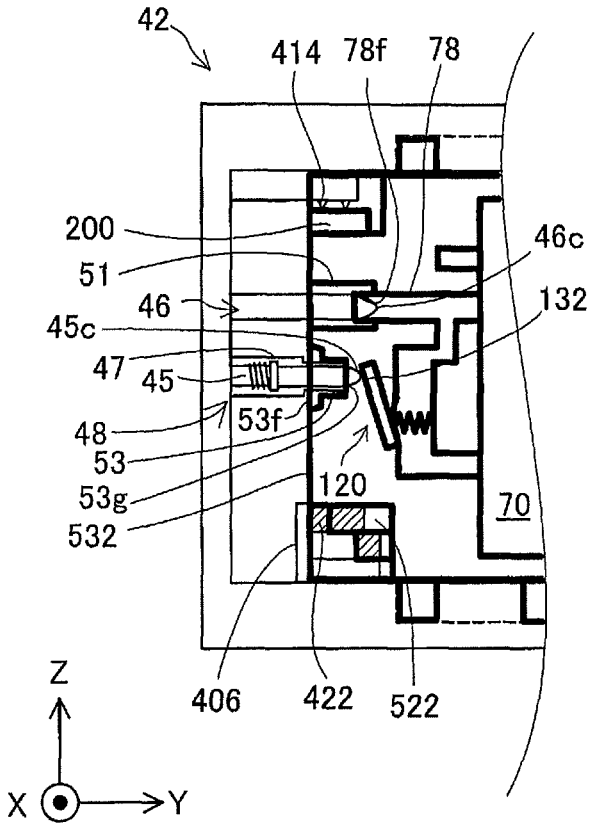
FIG. 9C is a third view schematically illustrating attachment of the cartridge to the cartridge mounting structure.

FIG. 5 is an exploded perspective view of the cartridge 50. FIG. 6 is a perspective view showing the appearance of the cartridge 50. FIG. 7A is a front view of the cartridge 50. FIGS. 7B and 7C are partial sectional views schematically illustrating a first insertion hole 53. FIG. 7B shows part of a 7X-7X cross section of the cartridge 50 in FIG. 7A, taken on a plane that is parallel to the X axis and the Y axis and includes a central axis Ce of the first insertion hole 53. FIG. 7C shows part of a 7Z-7Z cross section of the cartridge 50 in FIG. 7A, taken on a plane that is parallel to the Z axis and the Y axis and includes the central axis Ce of the first insertion hole 53. FIG. 7D illustrates a cross section of one side portion 53*y* and the other side portion 53*t* at a joint 53*h*, taken on a plane parallel to the Z axis and the X axis. FIG. 8 illustrates the internal structure of the cartridge 50. FIGS. 9A to 9C illustrate attachment of the cartridge 50 to the cartridge mounting structure 42 in time series in this order. The X-axis direction, the Y-axis direction and the Z-axis direction are also expressed as the width direction, the length direction and the height direction of the cartridge 50.

As shown in FIG. 5, the cartridge 50 includes a printing material containing portion 70, a cartridge casing 72 and a printing material supply unit 74.

The printing material containing portion 70 is structured to contain ink and is formed in a bag-like shape of a liquid-impermeable (e.g., ink-impermeable) film. The printing material supply unit 74 is mounted on the printing material containing portion 70.

As shown in FIG. 8, the printing material supply unit 74 includes a printing material filler port 76, a printing material detection mechanism 80, a printing material delivery tube 78 and a printing material flow path 90, which are formed integrally. The printing material filler port 76 is used to pour ink into the printing material containing portion 70 during manufacture of the cartridge 50 and is closed after ink pouring. The printing material detection mechanism 80 is used for detection of the out-of-ink state with the detection mechanism 300. The detailed structure of the printing material detection mechanism 80 will be described later. The printing material flow path 90 is used to lead the ink contained in the printing material containing portion 70 to the printer 10. Along the flow direction of ink from the printing material containing portion 70 to the printer 10, the printing material flow path 90 has an upstream end 77 open in the printing material containing portion 70 and a downstream end 78*f* open to the outside. The downstream end 78*f* is also called printing material supply port 78*f*. The printing material flow path 90 accordingly has the printing material supply port 78*f* at first end. The second end of the printing material flow path 90 is connected with the printing material containing portion 70. The printing material flow path 90 serves as the flow path connecting the printing material containing portion 70 to the outside. A downstream edge portion of the printing material flow path 90 including the printing material supply port 78*f* forms the printing material delivery tube 78 in a cylindrical shape. The printing material supply port 78*f* is located in a second insertion hole 51 as described later.

As shown in FIG. 5, the cartridge casing 72 includes a protective case 84 and a cap 82. The protective case 84 is designed to receive a most part of the printing material containing portion 70 therein. The protective case 84 is an approximate rectangular parallelepiped member having an opening 75 on its negative Y-axis side. The cap 82 is attached to the protective case 84 to seal the opening 75 of the protective case 84. The cap 82 is not securely fastened to the protective case 84 but is slightly movable relative to the protective case 84 by a clearance between the cap 82 and the protective case 84.

As shown in FIG. 6, the cartridge 50 has the approximate rectangular parallelepiped outer shape. The dimensions of the cartridge 50 descend in the order of the length direction (Y-axis direction), the height direction (Z-axis direction) and the width direction (X-axis direction). The cartridge 50 has six outer surfaces 532, 534, 536, 538, 539 and 540. More specifically, the cartridge 50 has a front face 532, a rear face 540, a first side face 534, a second side face 536, a third side face 538 and a fourth side face 539. The respective faces 532, 534, 536, 538, 539 and 540 are substantially flat surfaces. The front face 532 and negative Y-axis parts of the side faces 534, 536, 538 and 539 are formed by the cap 82. The rear face 540 and positive Y-axis parts of the side faces 534, 536, 538 and 539 are formed by the protective case 84. The parts of the first to fourth side faces 534, 536, 538 and 539 formed by the cap 82 are called first to fourth side faces of the cap 82. The parts of the first to fourth side faces 534, 536, 538 and 539 formed by the protective case 84 are called first to fourth side faces of the protective case 84. The respective faces 532, 534, 536, 538, 539 and 540 may not be perfectly flat surfaces. For example, the peripheries of the opening ends of the first insertion hole 53 and the second insertion hole 51 formed in the front face 532 may be slightly protruded as peripheral rims from the front face 532.

The front face 532 and the rear face 540 are opposed to each other in the Y-axis direction. The front face 532 is located on the negative Y-axis side and the rear face 540 is located on the positive Y-axis side. The rear face 540 faces the front face 532. The front face 532 is located on the negative Y-axis side of the printing material containing portion 70. In the attached state of the cartridge 50 to the cartridge mounting structure 42, the front face 532 faces the device front wall member 432. The rear face 540 is located on the positive Y-axis side of the printing material containing portion 70. The first side face 534 is located on the positive Z-axis side of the printing material containing portion 70. The first side face 534 and the second side face 536 intersect the front face 532 and the rear face 540. The first side face 534 and the second side face 536 are opposed to each other in the Z-axis direction. The first side face 534 is located on the positive Z-axis side and the second side face 536 is located on the negative Z-axis side. The first side face 534 is located on the positive Z-axis side of the printing material containing portion 70, whilst the second side face 536 is located on the negative Z-axis side of the printing material containing portion 70. The third side face 538 and the fourth side face 539 intersect the front face 532, the rear face 540, the first side face 534 and the second side face 536. The third side face 538 and the fourth side face 539 are opposed to each other in the X-axis direction. The third side face 538 is located on the positive X-axis side and the fourth side face 539 is located on the negative X-axis side. The third side face 538 is located on the positive X-axis side of the printing material containing portion 70, whilst the fourth side face 539 is located on the negative X-axis side of the printing material containing portion 70.

As shown in FIG. 7A, the second insertion hole 51 for insertion of the printing material supply tube 46 and the first insertion hole 53 for insertion of the rod 45 in the attached state of the cartridge 50 to the cartridge mounting structure 42 are formed in the front face 532 formed by the cap 82. As shown in FIG. 8, the second insertion hole 51 has a preset length in the Y-axis direction and is adapted to receive the printing material supply tube 46 (FIG. 3) inserted therein. Such insertion connects the printing material supply tube 46 with the printing material delivery tube 78 and supplies the ink contained in the printing material containing portion 70 through the printing material supply tube 46 and the tube 24 to the head 22. The state that the printing material supply tube 46 is connected with the printing material delivery tube 78 means that ink can be flowed from the printing material delivery tube 78 to the printing material supply tube 46.

The first insertion hole 53 is formed in the front face 532 at a middle position between the first side face 534 and the second side face 536. In other words, the first insertion hole 53 is located at the middle position in the Z-axis direction on the line segment connecting the first side face 534 with the second side face 536. Namely, the central axis Ce of the first insertion hole 53 is accordingly located at the middle position in the Z-axis direction between the first side face 534 and the second side face 536. The "middle position" may not be the exactly middle position but may be substantially middle position with no substantial bias to either of the first side face 534 and the second side face 536. For example, the "middle position" may include a range within 10% from a center position Vh along a distance Th in the Z-axis direction between the first side face 534 and the second side face 536. The "middle position" is not limited to the case where Tha and Thb are perfectly equal to each other, i.e., $Tha=Thb=0.5\times Th$, where Tha represents the distance from the first side face 534 to the central axis Ce of the first insertion hole 53 and Thb represents the distance from the second side face 536 to the central axis Ce of the first insertion hole 53. The "middle position" includes the position satisfying either $0.4\times Th \leqq Tha \leqq 0.6\times Th$ or $0.6\times Th \geqq Thb \geqq 0.4\times Th$. This range ensures the sufficient advantageous effects of the invention. When the middle position is in this range, there is no apparent bias of the first insertion hole 53 to either of the first side face 534 and the second side face 536 at a glance. In order to locate the central axis Ce of the first insertion hole 53 at the middle position as exactly as possible, it is preferable that the "middle position" includes a range within 7.5% from the center position Vh along the distance Th in the Z-axis direction between the first side face 534 and the second side face 536.

As shown in FIGS. 7B and 7C, the first insertion hole 53 has a preset length in the Y-axis direction. The first insertion hole 53 has an open end 53*f* on the negative Y-axis side and an open end 53*g* on the positive Y-axis side. The first insertion hole 53 also has one side portion 53*y* located on the negative Y-axis side and the other side portion 53*t* located on the positive Y-axis side of the one side portion 53*y*. The one side portion 53*y* and the other side portion 53*t* are respectively located on the negative Y-axis side and on the positive Y-axis side across a joint 53*h* as the boundary. The one side portion 53*y* includes the open end 53*f* on the negative Y-axis side, and the other side portion 53*t* includes the open end 53*g* on the positive Y-axis side. In other words, the portion from the joint 53*h* to the open end 53*f* on the negative Y-axis side is the one side portion 53*y*, whilst the portion from the joint 53*h* to the open end 53*g* on the positive Y-axis side is the other side portion 53*t*. As shown in FIGS. 7A and 7D, the one side portion 53*y* has a cross section parallel to the X axis and the Z axis in the shape of a circle. The diameter of the circle gradually decreases in the positive Y-axis direction from the open end 53*f*. As shown in FIG. 7B, the one side portion 53*y* also has a cross section parallel to the X axis and the Y axis and a cross section parallel to the Z axis and the Y axis in the shape of a trapezoid having the longer negative Y-axis side defined by the open end 53*f* and the shorter positive Y-axis side defined by the open end 53*g*. The one side portion 53*y* is accordingly a truncated cone. The other side portion 53*t* has a cross section parallel to the X axis and the Z axis in a non-circular shape. As shown in FIGS. 7A and 7D, the cross section of the other side portion 53*t* parallel to the X axis and the Z axis is in a shape defined by the combination of a pair of straight lines 53*p*, 53*p* opposed to each other in the Z-axis direction and two arcs 53*q*, 53*q* opposed to each other in the X-axis direction. The other side portion 53*t* has the same cross section from the joint 53*h* to the open end 53*g* on the positive Y-axis side. In other words, the other side portion 53*t* is formed in a columnar shape. As shown in FIGS. 7B and 7C, the cross section of the other side portion 53*t* parallel to the X axis and the Y axis and the cross section of the other side portion 53*t* parallel to the Z axis and the Y axis are both in rectangular shapes. The rectangular cross section parallel to the X axis and the Y axis shown in FIG. 7B has the smaller area than the rectangular cross section parallel to the Z axis and the Y axis shown in FIG. 7C. As shown in FIG. 7D, with respect to the cross sections of the other side portion 53*t* and the one side portion 53*y* parallel to the X axis and the Z axis at the joint 53*h*, the distance between the pair of straight lines 53*p*, 53*p* defining part of the cross section of the other side portion 53*t* is smaller than the diameter of the circle defining the cross section of the one side portion 53*y*, whilst the diameter of the pair of arcs 53*q*, 53*q* defining the remaining part of the cross section of the other side portion 53*t* is equal to the diameter of the circle defining the cross section of the one side portion 53*y*. The term "equal" herein includes "substantially equal". Namely, the term "equal" covers a potential variation in dimensions caused by manufacturing errors. The cross section of the first insertion hole 53 parallel to the X axis and the Z axis accordingly varies in the following manner from the open end 53*f* on the negative Y-axis side to the open end 53*g* on the positive Y-axis side. This cross section is the shape of a circle in the one side portion 53*y*. The area of this circle gradually decreases from the open end 53*f* on the negative Y-axis side toward the joint 53*h*. The cross section is then changed to the shape defined by the combination of the pair of straight lines 53*p*, 53*p* and the pair of arcs 53*q*, 53*q* at the joint 53*h* or at the entrance of the other side portion 53*t*. With this shape change, the cross section has the smaller length in the Z-axis direction, since the distance between the pair of straight lines 53*p*, 53*p* is smaller than the diameter of the circle defining the cross section of the one side portion 53*y*. The cross section, however, has the same length in the X-axis direction, since the diameter of the pair of arcs 53*q*, 53*q* is equal to the diameter of the circle defining the cross section of the one side portion 53*y*. There is no change in shape and area of the cross section from the joint 53*h* to the open end 53 on the positive Y-axis side. The rod 45 is inserted into the first insertion hole 53 from its negative Y-axis side toward the positive Y-axis side. The open end 53*f* on the negative Y-axis side or the entrance is made wider to readily receive the rod 45. The open end 53*g* on the positive Y-axis side is made narrower, so that insertion of the rod 45 to the open end 53*g* on the positive Y-axis side allows positioning of the cartridge 50 with high accuracy. The area of the cross section in the one side portion 53*y* gradually decreases from the open end 53*f* on the negative Y-axis side toward the joint 53*h*. The cross section changes the shape at the joint 53*h* or the entrance of the other side portion 53*t* to have the smaller length in the Z-axis direction but keep the same length in the X-axis direction as that of the one side portion 53*y*. There is no change in shape and area of the cross section from the joint 53*h* to the open end 53*g* on the positive Y-axis side. This structure enables the rod 45 to be smoothly guided from the one side portion 53*y* to the other side portion 53*t*. The other side portion 53*t* has a clearance between the rod 45 and the first insertion hole 53 in the X-axis direction in order to smoothly guide the rod 45 to the open end 53*g* on the positive Y-axis side, while stabilizing the position of the rod 45 in the Z-axis direction to enable the cartridge 50 to be accurately positioned relative to the cartridge mounting structure 42.

As shown in FIGS. 7A and 8, the cartridge 50 further has a cartridge-side identification member 520 (also called "identification member" 520) on the cap 82. The identification member 520 is provided in a corner section 55 with a recess where the front face 532 intersects the second side face 536. Like the device-side identification member 420, the identification member 520 has at least one rib 522 and is formed in a different pattern corresponding to the color of ink contained in the cartridge 50. More specifically, as shown in FIG. 7A, the recess of the corner section 55 is parted into eight areas (shown by lattice in FIG. 7A), and the ribs 522 are placed in part or all of the eight areas. The areas where the ribs 522 are placed depend on the ink color of the cartridge 50. The areas where the ribs 522 are placed are hatched as one example of the rib pattern in FIG. 7A. The identification member 520 is omitted from the illustration of FIGS. 5 and 6. A negative Y-axis end of the cartridge-side identification member 520 is called "end face 520*f*" as shown in FIG. 8.

The relationship among the printing material delivery tube 78, the first insertion hole 53 and the identification member 520 is described with reference to FIG. 8 and FIGS. 9A to 9C, prior to description of the other components of the cartridge 50. The portion of the rod 45 located on the negative Y-axis side of the device front wall member 432 (i.e., the negative Y-axis side portion 45*a* shown in FIG. 3) is omitted from the illustration of FIGS. 9A to 9C. The cartridge 50 is structured, such that the rod 45 is inserted into the first insertion hole 53 before the printing material supply tube 46 is inserted into the printing material supply port 78*f* in the course of attachment of the cartridge 50 to the cartridge mounting structure 42. According to this embodiment, the open end 53*f* of the first insertion hole 53 is located on the negative Y-axis side to the printing material supply port 78*f* as shown in FIG. 8. This structure enables the rod 45 to be inserted into the first insertion hole 53 first as shown in FIG. 9A.

The cartridge 50 is also structured, such that the fit between the cartridge-side identification member 520 and the device-side identification member 420 starts after insertion of the rod 45 into the first insertion hole 53 but before insertion of the printing material supply tube 46 into the printing material supply port 78*f* in the course of attachment of the cartridge 50 to the cartridge mounting structure 42. According to this embodiment, the end face 520*f* of the cartridge-side identification member 520 is located on the positive Y-axis side to the open end 53*f* on the negative Y-axis side of the first insertion hole 53 and on the negative Y-axis side to the printing material supply port 78*f* as shown in FIG. 8. This structure sequentially triggers the insertion of the rod 45 into the first insertion hole 53 as shown in FIG. 9A, the start to fit between the cartridge-side identification member 520 and the device-side identification member 420 as shown in FIG. 9B, and the insertion of the printing material supply tube 46 into the printing material supply port 78*f* to be connected with the printing material delivery tube 78 as shown in FIG. 9C. In the state where the attachment of the cartridge 50 to the cartridge mounting structure is completed (i.e., in the attached state) shown in FIG. 9C, the rod cover 47 as well as the rod 45 is inserted into the first insertion hole 53.

Almost simultaneously with the timing when the printing material supply tube 46 is connected with the printing material delivery tube 78, the cartridge 50 abuts the restriction members 406 (FIG. 2) to prevent further motion of the cartridge 50 in the negative Y-axis direction. According to this embodiment, the restriction members 406 abut the negative Y-axis side face (front face 532) of the cartridge 50 (FIG. 9C).

In the attached state of the cartridge 50 to the cartridge mounting structure 42, cartridge-side terminals 202 on a circuit board 200 are electrically connected with the device-side terminals 414, so as to enable signal transmission between the circuit board 200 and the controller 60 of the printer 10 (FIG. 1).

The components of the cartridge 50 are further described with reference to FIGS. 5 to 8. As shown in FIGS. 5 to 8, the cartridge 50 has the circuit board 200 on the cap 82. More specifically, the circuit board 200 is provided in a corner section 52 where the front face 532 intersects the first side face 534. As shown in FIG. 7A, the circuit board 200 has a plurality of cartridge-side terminals 202 provided on its surface and a memory unit 204 provided on its rear face. Information on the cartridge 50 (for example, ink color) is stored in the memory unit 204. In the attached state, the plurality of cartridge-side terminals 202 are respectively in contact with the corresponding device-side terminals 414. This enables signal transmission between the circuit board 200 and the controller 60 (FIG. 1).

As shown in FIGS. 5 to 8, the first side face 534 consists of a first side face 534*a* of the cap 82 and a first side face 534*b* of the protective case 84.

A first cartridge projection 56 is provided on the first side face 534. The first cartridge projection 56 is protruded from the first side face 534 in the positive Z-axis direction and is extended in the Y-axis direction. The first cartridge projection 56 includes a first projection 56*a* provided on the first side face 534*a* of the cap 82 and a first case-side projection 56*b* provided on the first side face 534*b* of the protective case 84. The first projection 56*a* is protruded in the positive Z-axis direction from the first side face 534*a* of the cap 82. The first case-side projection 56*b* is protruded in the positive Z-axis direction from the first side face 534*b* of the protective case 84 and is extended in the Y-axis direction. The first cartridge projection 56 (56*a* and 56*b*) is guided by the first rail 402 (FIGS. 2 and 3) in the course of insertion of the cartridge 50 into the cartridge mounting structure 42 (FIGS. 2 and 3) and in the course of removal of the cartridge 50 from the cartridge mounting structure 42.

The second side face 536 consists of a second side face 536*a* of the cap 82 and a second side face 536*b* of the protective case 84. A second cartridge projection 58 is provided on the second side face 536. The second cartridge projection 58 is protruded from the second side face 536 in the negative Z-axis direction and is extended in the Y-axis direction. The second cartridge projection 58 includes a second projection 58*a* provided on the second side face 536*a* of the cap 82 and a second case-side projection 58*b* provided on the second side face 536*b* of the protective case 84. The second projection 58*a* is protruded in the negative Z-axis direction from the second side face 536*a* of the cap 82. The second case-side projection 58*b* is protruded in the negative Z-axis direction from the second side face 538*b* 536*b* of the protective case 84 and is extended in the Y-axis direction. The second cartridge projection 58 (58*a* and 58*b*) is guided by the second rail 404 (FIGS. 2 and 3) in the course of insertion of the cartridge 50 into the cartridge mounting structure 42 (FIGS. 2 and 3) and in the course of removal of the cartridge 50 from the cartridge mounting structure 42.

As shown in FIG. 7A, the first cartridge projection 56 (56*a* and 56*b*) has a length Tc in the X-axis direction, which is different from a length Td of the second cartridge projection 58 (58*a* and 58*b*) in the X-axis direction. More specifically, the length Td of the second cartridge projection 58 (58*a* and 58*b*) in the X-axis direction is greater than the length Tc of the first cartridge projection 56 (56*a* and 56*b*) in the X-axis direction. Correspondingly, as shown in FIG. 2, the length Tb, of the second rail 404 formed in the cartridge mounting structure 42 to guide the second cartridge projection 58 (58*a* and 58*b*), in the X-axis direction, is greater than the length Ta, of the first rail 402 formed in the cartridge mounting structure 42 to guide the first cartridge projection 56 (56*a* and 56*b*), in the X-axis direction. In other words, the length Ta of the first rail 402 in the X-axis direction corresponds to the length Tc of the first cartridge projection 56 (56*a* and 56*b*) in the X-axis direction. The length Tb of the second rail 404 in the X-axis direction corresponds to the length Td of the second cartridge projection 58 (58*a* and 58*b*) in the X-axis direction. The length Td of the second cartridge projection 58 (58*a* and 58*b*) in the X-axis direction is smaller than the length Tb of the second rail 404 in the X-axis direction and is greater than the length Ta (56*a* and 56*b*) of the first rail 402 in the X-axis direction. The length Tc of the first cartridge projection 56 (56*a* and 56*b*) in the X-axis direction is smaller than the length Ta of the first rail 402 in the X-axis direction. There is accordingly the relationship of $Tc<Ta<Td<Tb$. This structure advantageously prevents attachment of the cartridge 50 in the wrong attitude, i.e., upside down in the Z-axis direction, to the cartridge mounting structure 42. In the state where the first side face 534 and the second side face 536 are upside down, the second cartridge projection 58 or more specifically the second projection 58*a* provided on the second side face 536*a* of the cap 82 is not inserted or fit in the first rail 402. This prevents upside-down attachment of the cartridge 50 to the cartridge mounting structure 42.

As shown in FIGS. 6 and 8, the first projection 56*a* and the first case-side projection 56*b* are arranged across a gap 56*c* in the Y-axis direction. Similarly the second projection 58*a* and the second case-side projection 58*b* are arranged across a gap 58*c* in the Y-axis direction. As shown in FIG. 8, in the attached state, leaf springs Sp provided on the cartridge mounting structure 42 enter the gaps 56*c* and 58*c* to press the cartridge 50 toward the device front wall member 432.

According to this embodiment, the first cartridge projection 56 or more specifically the first case-side projection 56*b* is formed in a continuous shape extended in the Y-axis direction. Similarly the second cartridge projection 58 or more specifically the second case-side projection 58*b* is formed in a continuous shape extended in the Y-axis direction. This continuous shape extended in the Y-axis direction is, however, not essential. Only the first projection 56*a* and the second projection 58*a* provided on the respective negative Y-axis ends of the first side face 534 and the second side face 536 are sufficient to prevent attachment of the cartridge 50 in the wrong attitude, i.e., upside down in the Z-axis direction, to the cartridge mounting structure 42. In order to prevent inclination of the cartridge 50 to the cartridge mounting structure 42 during attachment or detachment, it is required to provide at least two projections arranged across a certain interval in the Y-axis direction on the first side face 534 and at least two projections arranged across a certain interval in the Y-axis direction on the second side face 536. The projections of the continuous shape extended in the Y-axis direction are not essential.

A-3-2. Description on Printing Material Supply Unit

Figure 10:
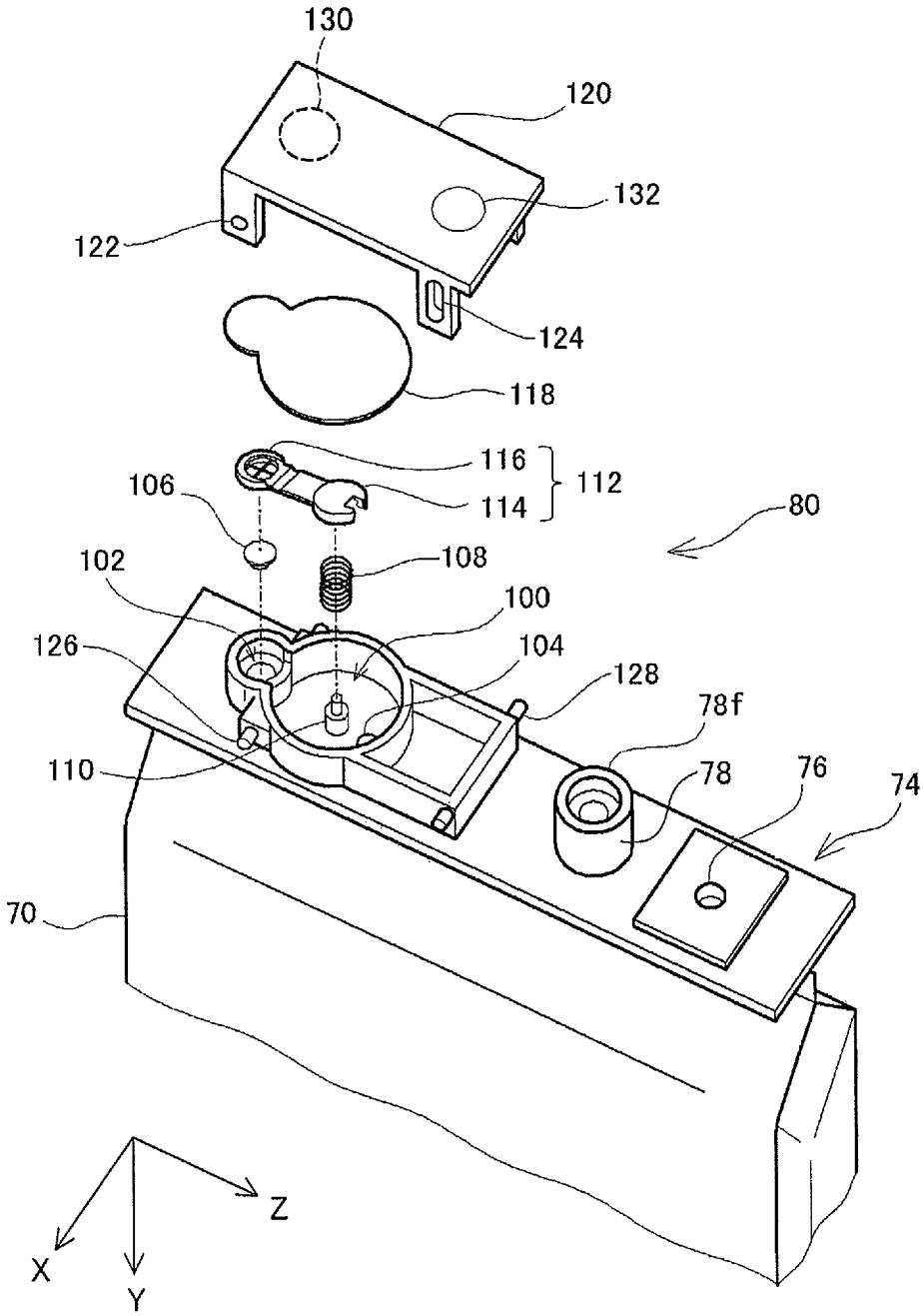
FIG. 10 is an exploded perspective view illustrating the structure of a printing material supply unit.

FIG. 10 is an exploded perspective view illustrating the structure of the printing material supply unit 74. The printing material detection mechanism 80 includes a detection chamber 100 in an substantially cylindrical shape. The detection chamber 100 is provided in the midstream of the printing material flow path 90 (FIG. 8). The detection chamber 100 has a flow inlet 102, through which ink flows in from the printing material containing portion 70, and a flow outlet 104, through which ink flows out to the printing material supply port 78*f*. An upper end face of the detection chamber 100 is covered with a film 118 of a flexible material. The film 118 is deformed corresponding to a change in internal pressure of the detection chamber 100, so as to vary the internal volume of the detection chamber 100.

The printing material detection mechanism 80 also has a check valve 106 and a spring 108, which are located in the detection chamber 100. The check valve 106 prevents the backflow of ink flowing in through the flow inlet 102 into the detection chamber 100. The spring 108 presses the film 118 outward of the detection chamber 100. More specifically, the spring 108 is provided in the compressed state in the detection chamber 100 and is positioned by being set on a protrusion 110 protruded upward from the bottom face of the detection chamber 100. A pressure-receiving plate 112 is placed between the spring 108 and the film 118. The pressure-receiving plate 112 includes a pressure-receiving element 114 which transmits the pressing force of the spring 108 to the film 118 and a restricting element 116 which restricts the motion of the check valve 106, which are joined together and integrally formed. Fitting the restricting element 116 of the pressure-receiving plate 112 in the flow inlet 102 of the detection chamber 100 restricts the upward motion of the check valve 106 and positions the pressure-receiving element 114 between the spring 108 and the film 118. The pressure-receiving element 114 and the restricting element 116 are integrally formed according to this embodiment, but may be provided as separate elements.

The printing material detection mechanism 80 further has a lever member 120, which is provided outside the detection chamber 100 to be in contact with the film 118 forming one end face (upper end face in the drawing) of the detection chamber 100. The lever member 120 has a shaft hole 122 on one end. Fitting a shaft pin 126 provided on the outer surface of the detection chamber 100 in the shaft hole 122 causes the lever member 120 to be supported by the shaft pin 126 in a pivotally rotatable manner. The lever member 120 has a guide hole 124 on the other end. A guide pin 128 fixed to the printing material supply unit 74 is inserted into the guide hole 124, so as to guide the pivotal rotation of the lever member 120. A convex 132 is provided on the upper surface of the lever member 120 (i.e., the surface opposite to the surface facing the film 118) to serve as an abutting element to abut the positive Y-axis apex 45*c* of the rod 45 (FIGS. 3 and 4) on the cartridge mounting structure 42. In vertical projection of the cartridge 50 to the plane parallel to the X axis and the Z axis, the convex 132 and the first insertion hole 53 overlap each other at least partly. The ink contained in the printing material containing portion 70 with the printing material detection mechanism 80 of this structure is supplied to the cartridge mounting structure 42 as described below.

Figure 11:
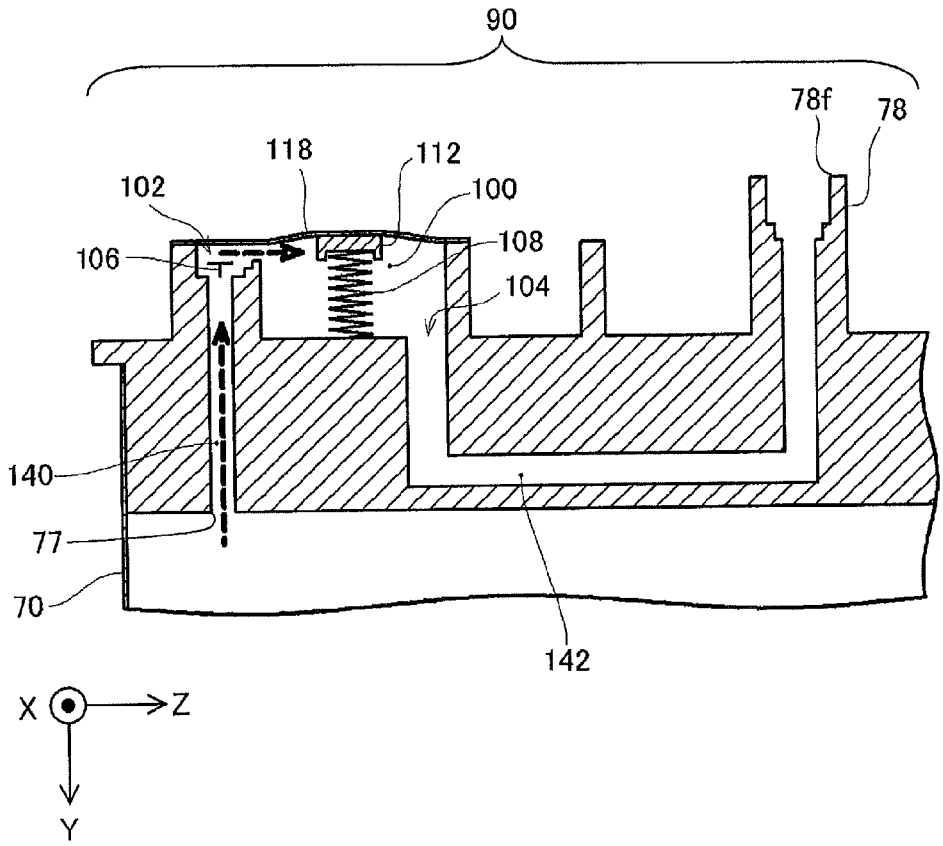
FIG. 11 illustrates supplying ink to the cartridge mounting structure.
Figure 12:
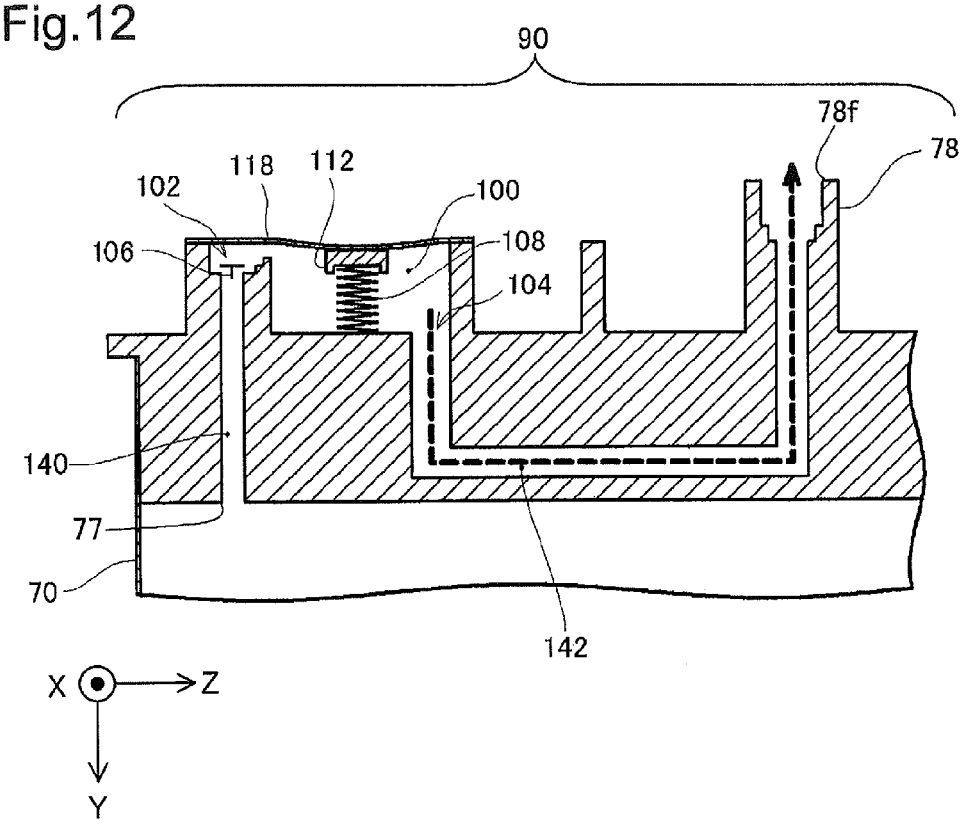
FIG. 12 illustrates supplying ink to the cartridge mounting structure.

FIG. 11 is a first sectional view illustrating the state that ink contained in the printing material containing portion 70 is supplied to the cartridge mounting structure 42. FIG. 12 is a second sectional view illustrating the state that ink contained in the printing material containing portion 70 is supplied to the cartridge mounting structure 42. For the better understanding, the lever member 120 and the restricting element 116 of the pressure-receiving plate 112 are omitted from the illustration of FIGS. 11 and 12. A supply pump (not shown) is built in the cartridge mounting structure 42 to suck ink from the cartridge 50 and pressure-feed the sucked ink to the carriage 20. FIG. 11 shows the state where the supply pump of the cartridge mounting structure 42 does not work, and FIG. 12 shows the state where the supply pump of the cartridge mounting structure 42 works.

As shown in FIG. 11, when the supply pump of the cartridge mounting structure 42 does not work, the spring 108 presses up the film 118 to increase the volume of the detection chamber 100. With an increase in volume of the detection chamber 100, ink flows into the detection chamber 100 through an inflow path 140 arranged to connect the printing material containing portion 70 with the flow inlet 102. The check valve 106 is placed in the flow inlet 102 to allow the inflow of ink into the detection chamber 100 but prohibit the backflow of ink. The arrows of broken line represent the ink flow.

When the supply pump of the cartridge mounting structure 42 works, ink is sucked via the printing material delivery tube 78 and flows out of the detection chamber 100 through an outflow path 142 arranged to connect the flow outlet 104 with the printing material delivery tube 78 to be supplied to the cartridge mounting structure 42. In the cartridge 50 according to the embodiment, the inner diameter of the outflow path 142 is set to be greater than the inner diameter of the inflow path 140. The ink inflow into the detection chamber 100 does not keep up with the ink outflow from the detection chamber 100, so that the detection chamber 100 has negative pressure. The film 118 is accordingly deformed against the pressing force of the spring 108 to be pulled inward of the detection chamber 100 as shown in FIG. 12.

The negative pressure in the detection chamber 100 is gradually cancelled by the ink flow of ink from the printing material containing portion 70 through the inflow path 140 into the detection chamber 100. The film 118 is then pressed outward of the detection chamber 100 again by the pressing force of the spring 108 to restore the volume of the detection chamber 100. After a predetermined time period has elapsed since the stop of the supply pump of the cartridge mounting structure 42, the state of the detection chamber 100 is returned to the state of FIG. 11. When the supply pump of the cartridge mounting structure 42 works again, the detection chamber 100 has negative pressure to pull the film 118 inward of the detection chamber 100 again as shown in FIG. 12.

When ink in the printing material containing portion 70 is consumed and used up, no ink flows from the printing material containing portion 70 to the detection chamber 100, irrespective of the negative pressure. In this case, even after the predetermined time period has elapsed since the stop of the supply pump of the cartridge mounting structure 42, the negative pressure of the detection chamber 100 is not canceled, and the film 118 is kept to be pulled inward of the detection chamber 100 as shown in FIG. 12.

As described above, when the printing material containing portion 70 is in the out-of-ink state, the film 118 forming one end face of the detection chamber 100 is kept deformed to be pulled inward of the detection chamber 100. Detecting the displacement of the film 118 with the detection mechanism 300 (FIG. 4) accordingly results in detecting the out-of-ink state in the printing material containing portion 70. The displacement of the film 118 is relatively small and is amplified by the lever member 120 according to the embodiment as described below.

Figure 13:
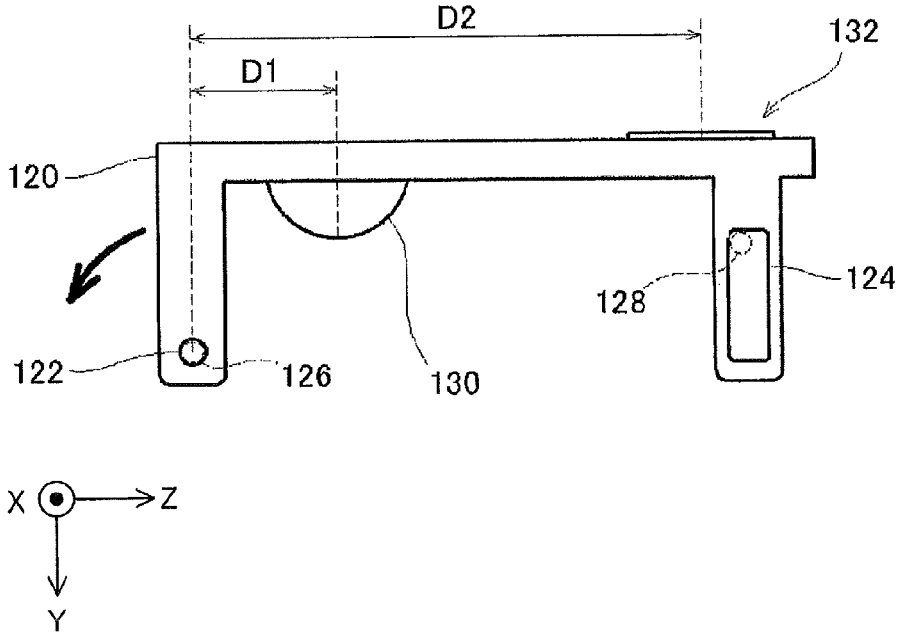
FIG. 13 illustrates the structure of a lever member.

FIG. 13 illustrates the structure of the lever member 120 provided on the cartridge 50 according to the embodiment. The lever member 120 has the shaft hole 122 on one end. The lever member 120 is pivotally rotated about the shaft hole 122, in which the shaft pin 126 (FIG. 10) provided on the outer surface of the detection chamber 100 is inserted. The lever member 120 has the guide hole 124 on the other end. The guide pin 128 (FIG. 10) fixed to the printing material supply unit 74 is inserted into the guide hole 124. During pivotal rotation of the lever member 120, the guide pin 128 moves along the guide hole 124, so as to guide the pivotal rotation of the lever member 120. This structure accordingly restricts the pivotal rotation of the lever member 120 with high accuracy.

A hemispherical projection 130 is provided on the lower surface of the lever member 120 facing the film 118 to be in contact with the film 118. The convex or abutting element 132 is provided on the surface of the lever member opposite to the surface facing the film 118. The abutting element 132 abuts the positive Y-axis apex 45*c* of the rod 45 (FIGS. 3 and 4) on the cartridge mounting structure 42. A distance D2 between the shaft hole 122 as the pivot point of rotation of the lever member 120 and the abutting element 132 is set to be greater than a distance D1 between the shaft hole 122 and the hemispherical projection 130. The displacement of the film 118 in contact with the hemispherical projection 130 is amplified by a lever ratio R=D2/D1 (R>1, 3.1 in this embodiment) to determine the displacement of the abutting element 132. The displacement of the film 118 amplified by the lever member 120 is transmitted to the rod 45 provided in the cartridge mounting structure 42 as described above. The amplified displacement of the film 118 corresponds to the moving distance of the rod 45. For accurate detection of the out-of-ink state with the detection mechanism 300, it is required to make the rod 45 abut the lever member 120 at the exact designed position. When the rod 45 abuts the lever member 120 at the position different from the abutting element 132, the positional relationship between the light shield 138 and the sensor 136 is significantly deviated from the designed positional relationship, which leads to erroneous detection of the out-of-ink state.

A-4. Detection of Out-of-Ink State

Figure 14:
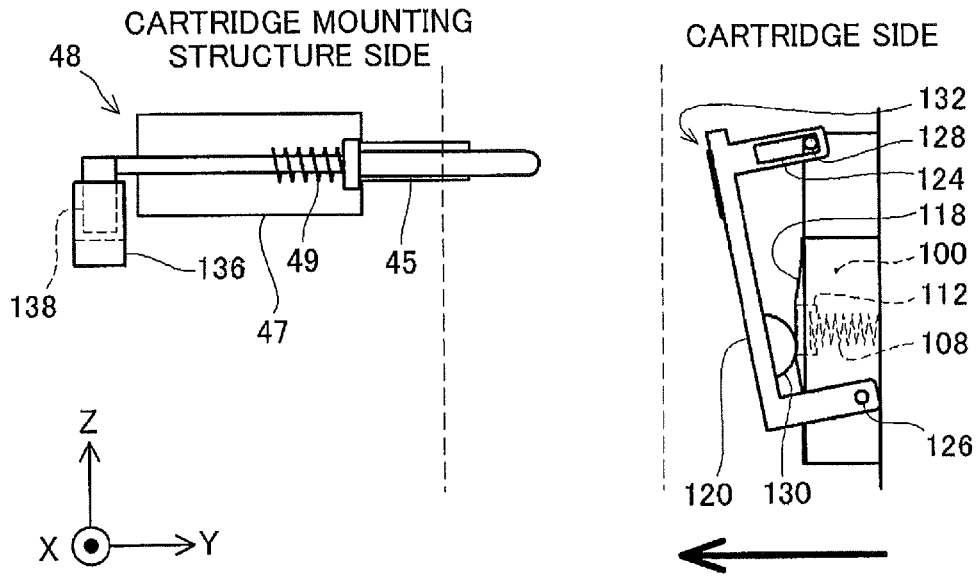
FIG. 14 is a first view illustrating detection of the out-of-ink state.
Figure 15:
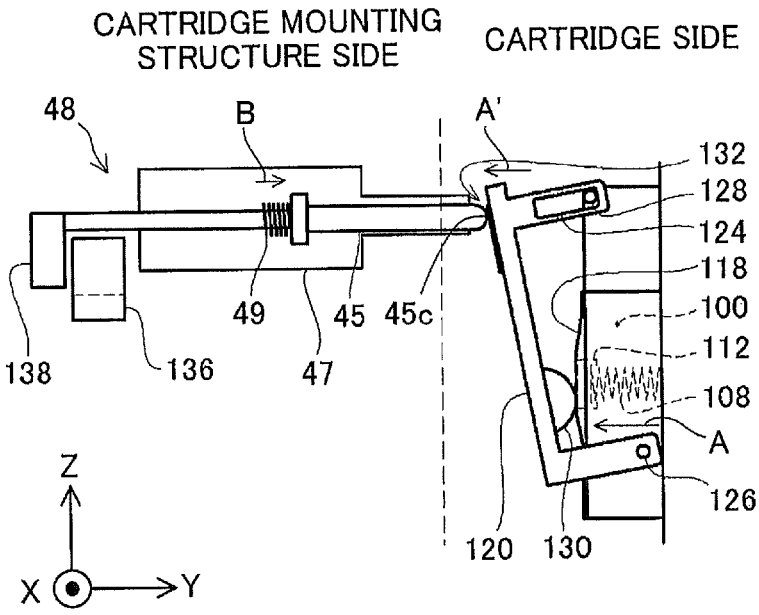
FIG. 15 is a second view illustrating detection of the out-of-ink state.
Figure 16:
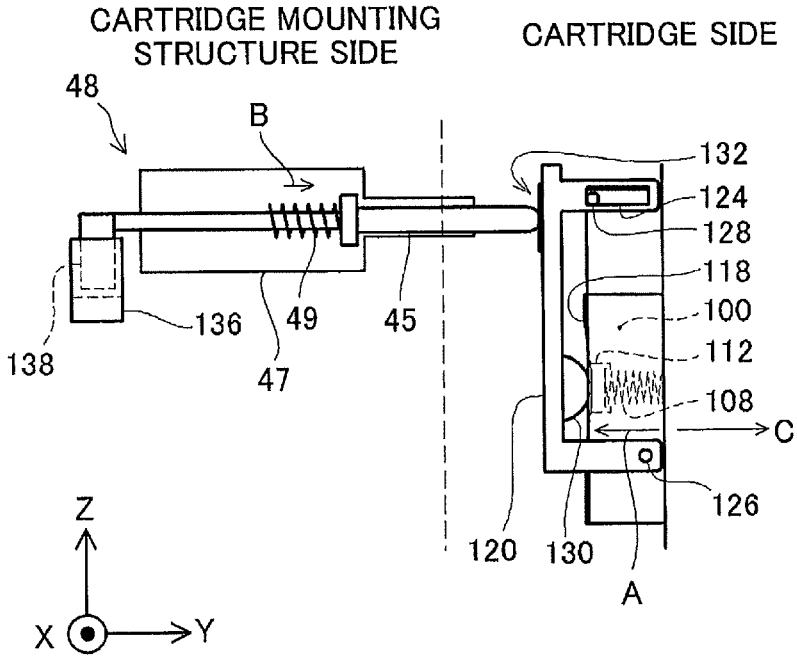
FIG. 16 is a third view illustrating detection of the out-of-ink state.

Detection of the out-of-ink state is described in detail with reference to FIGS. 14 to 16. FIG. 14 is a first view illustrating detection of the out-of-ink state and shows the state before the cartridge 50 or more specifically the cartridge 50 containing a sufficient amount of ink is attached to the cartridge mounting structure 42. FIG. 15 is a second view illustrating detection of the out-of-ink state and shows the state when the cartridge 50 containing a sufficient amount of ink is attached to the cartridge mounting structure 42. FIG. 16 is a third view illustrating detection of the out-of-ink state and shows the state when the ink cartridge 50 attached to the cartridge mounting structure 42 has no ink or little ink (i.e., out-of-ink state).

In the state of FIG. 14, the spring 49 presses the rod 45 toward the cartridge 50. When the cartridge 50 is not attached to the cartridge mounting structure 42 (FIG. 3), the rod 45 moves toward the cartridge 50 by the pressing force of the spring 49. The light shield 138 of the rod 45 accordingly enters between the light-emitting element and the light-receiving element of the sensor 136 to shield the light emitted from the light-emitting element. This light-shielding state is equivalent to the out-of-ink state described later with reference to FIG. 16. The printer 10 is controlled to be incapable of printing in this state. For attachment of the cartridge 50 to the cartridge mounting structure 42, the cartridge 50 is inserted in the direction of the arrow, i.e., in the negative Y-axis direction. For detachment of the cartridge 50 from the cartridge mounting structure 42, on the other hand, the cartridge 50 is pulled in the opposite direction to the arrowed direction, i.e., in the positive Y-axis direction. The cartridge 50 shown in FIG. 14 contains a sufficient amount of ink.

In the state of FIG. 15 when the cartridge 50 containing a sufficient amount of ink is attached to the cartridge mounting structure 42, the positive Y-axis apex 45*c* of the rod 45 abuts the abutting element 132 of the lever member 120 provided on the cartridge 50. A pressing force A' applied to the abutting element 132 of the lever member 120 by a pressing force A of the spring 108 of the cartridge 50 is set to be greater than a pressing force B of the spring 49. When the positive Y-axis apex 45*c* of the rod 45 abuts the lever member 120, the rod 45 accordingly moves toward the depth of the cartridge mounting structure 42 (i.e., in the negative Y-axis direction) against the pressing force B of the spring 49. The light shield 138 of the rod 45 is then away from the sensor 136 to allow light transmission. The sensor 136 detects attachment of the cartridge 50 to the cartridge mounting structure 42, based on the change from the light-shielding state to the light transmission state with the movement of the light shield 138 of the rod 45. This state is maintained until the printing material containing portion 70 has no ink or little ink. The printer 10 is controlled to be capable of printing in this state, unless there is any other abnormality arising in the cartridge 50 or the printer 10. The types of "other abnormality" and the method of detecting such abnormalities are known in the art and are not specifically described here.

As shown in FIG. 16, when there is no ink or little ink in the printing material containing portion 70, no ink flows from the printing material containing portion 70 to the detection chamber 100, so that the detection chamber 100 has negative pressure. The pressing force A of the spring 108 of the cartridge 50 is set to be smaller than a force C produced by the negative pressure in the state of no ink or little ink in the printing material containing portion 70. This force C works to keep the film 118 pulled inward of the detection chamber 100. Deformation of the film 118 to decrease the volume of the detection chamber 100 displaces the rod 45 in the positive Y-axis direction by the pressing force B of the spring 49. Accompanied with such displacement, the rod 45 turns the lever member 120 following the deformation of the film 118 and keeps the lever member 120 in its closed position. The rod 45 accordingly moves toward the cartridge 50 and causes the light shield 138 of the rod 45 to enter between the light-emitting element and the light-receiving element of the sensor 136. The sensor 136 detects no ink or little ink (out-of-ink state) in the printing material containing portion 70, based on the light-shielding state by the light shield 138 of the rod 45 (i.e., movement of the rod 45). The printer 10 is controlled to be incapable of printing in this state.

The displacement of the film 118 itself in the Y-axis direction is relatively small but is amplified by the preset lever ratio R=D2/D1 (R>1, FIG. 13) at the abutting element 132 on the lever member 120. This structure of the embodiment enables a significant displacement of the rod 45 even when the displacement of the film 118 itself in the Y-axis direction is relatively small. The pressing force B of the spring 49 applied to the rod 45 is amplified by the lever ratio R of the lever member 120. With a change from the state of FIG. 15 to the state of FIG. 16, the lever member 120 is smoothly turned with a relatively small force, which ensures prompt detection of the out-of-ink state.

A-5. Advantageous Effects

As described above, the cartridge 50 of the embodiment does not have any piezoelectric detection mechanism to detect the out-of-ink state. The cartridge 50 accordingly does not need to have the power supply means or the electrical conduction means (e.g., wiring or electrode terminals) for transmission of signals between the detection mechanism and the printer 10. This advantageously simplifies the structure of the cartridge 50 and enables size reduction of the cartridge 50. Moreover, this enables size reduction of as printing device, to which the cartridges 50 are attached. This also reduces the manufacturing cost of the cartridge 50. Reducing the manufacturing cost of the mass-produced replaceable cartridges 50 compared with printer 10 results in reducing the manufacturing cost of the whole printing material supply system 1.

The first insertion hole 53, in which the rod 45 is inserted, is provided on the front face 532 at the middle position between the first side face 534 and the second side face 536 (FIG. 7). Inserting the rod 45 used for detection of the out-of-printing material state into the first insertion hole 53 enables positioning of the cartridge 50 relative to the cartridge mounting structure 42 in the middle along the longitudinal direction of the front face 532 of the cartridge 50. This effectively prevents the positional misalignment of the cartridge 50 relative to the rod 45 and ensures accurate detection of the out-of-ink state with the detection mechanism 300.

The front face 532 of the cartridge 50 has the greater length in the Z-axis direction than in the X-axis direction. When the first insertion hole 53 is formed at the position closer to either the first side face 534 or the second side face 536, there may be difficulty in accurately positioning the cartridge 50. For example, when the first insertion hole 53 is formed at the position closer to the first side face 534, inserting the rod 45 into the first insertion hole 53 restricts the backlash or shaky motion of the first side face 534-side of the cartridge 50 but does not restrict the backlash or shaky motion of the second side face 534-side of the cartridge 50, which is away from the first insertion hole 53. The second side face 534-side of the cartridge 50 may thus be deviated from the designed attachment position. According to the structure of the embodiment, however, the first insertion hole 53 is provided at the middle position between the first side face 534 and the second side face 536, so as to restrict the backlash or shaky motion of both the first side face 534-side and the second side face 536-side of the cartridge 50 almost equivalently. This ensures accurate and efficient positioning of the cartridge 50 relative to the cartridge mounting structure 42.

According to the embodiment, the rod 45 used for detection of the out-of-ink state also serves as the member for positioning the cartridge 50 to the cartridge mounting structure 42. The printing material supply system 1 accordingly does not need to have any additional positioning member. This reduces the total number of parts required for the printing material supply system 1. The rod 45 serves as both the member for detecting the out-of-ink state and as the member for positioning the cartridge 50 to the cartridge mounting structure 42. The cartridge 50 accordingly does not need to have any additional positioning member. This reduces the number of parts required for the cartridge 50 and enables size reduction of the cartridge 50 and the printing device 10, to which the cartridges 50 are attached.

In the attached state, the rod cover 47, as well as the rod 45 moving along the Y-axis direction, is inserted into the first insertion hole 53. This prevents the rod 45 from coming into contact with the wall member surrounding the first insertion hole 53 and ensures smooth movement of the rod 45 with a change in volume of the detection chamber 100, thus enabling detection of the out-of-ink state with high accuracy.

As shown in FIGS. 5 and 6, according to this embodiment, the cartridge casing 72 includes the cap 82 and the protective case 84. The protective case 84 accommodates the printing material containing portion 70 therein. The cap 82 has the second insertion hole 51 and the first insertion hole 53, in which the corresponding elements provided on the cartridge mounting structure 42 are inserted. The side of the protective case 84 has the greater total weight than the side of the cap 82. Continuously forming the first side face 534 of the cartridge casing from the front face 532 (negative Y-axis end) to the rear face 540 (positive Y-axis end) may tilt the cartridge with the rear face 540 lower than the front face 532. According to this embodiment, however, the protective case 84 which accommodates the printing material containing portion 70 and the cap 82 are formed as discrete members arranged across the clearance. This clearance allows the protective case 84 to be slightly moved relative to the cap 82. Even when the printing material containing portion 70 has a relatively large weight, only the protective case 84 is slightly tilted, but the cap 82 is kept in the proper attitude without any tilting. This structure advantageously reduces the possibility that the positions of the second insertion hole 51 and the first insertion hole 53 formed in the cap 82 relative to the cartridge mounting structure 42 are deviated from the designed correct positions in the attached state of the cartridge 50 to the cartridge mounting structure.

According to this embodiment, the cartridge-side terminals 202 are provided on the cap 82 with the less possibility of deviation from the correct position. This ensures stable electrical connection between the cartridge-side terminals 202 and the device-side terminals 414 in the attached state.

As shown in FIGS. 6 and 7A, according to this embodiment, the first projection 56*a* protruded in the positive Z-axis direction is provided on the first side face 534*a* of the cap 82, and the second projection 58*a* protruded in the negative Z-axis direction is provided on the second side face 536*a* of the cap 82. The first projection 56*a* is guided by the first rail 402 formed in the first device side wall member 434 (FIGS. 2 and 3) in the course of insertion of the cartridge 50 into the cartridge mounting structure 42 (FIGS. 2 and 3) and in the course of removal of the cartridge 50 from the cartridge mounting structure 42. The second projection 58*a* is guided by the second rail 404 formed in the second device side wall member 436 (FIGS. 2 and 3) in the course of insertion of the cartridge 50 into the cartridge mounting structure 42 (FIGS. 2 and 3) and in the course of removal of the cartridge 50 from the cartridge mounting structure 42. The length Tc of the first projection 56*a* in the X-axis direction is different from the length Td of the second projection 58*a* in the X-axis direction. The length Ta of the first rail 402 in the X-axis direction corresponds to the length Tc of the first projection 56*a* in the X-axis direction, whilst the length Tb of the second rail 404 in the X-axis direction corresponds to the length Td of the second projection 58*a* in the X-axis direction. This structure effectively prevents attachment of the cartridge 50 in the wrong attitude, i.e., upside down of the first side face 534 and the second side face 536 in the Z-axis direction, to the cartridge mounting structure 42.

According to this embodiment, the open end 53*f* on the negative Y-axis side of the first insertion hole 53 is provided at the position that allows insertion of the rod 45 prior to insertion of the printing material supply tube 46 into the printing material supply port 78*f* (FIGS. 8 and 9A). The printing material supply tube 46 is thus connected with the printing material supply port 78*f*, after the cartridge 50 is guided to the correct position in the cartridge mounting structure 42 by means of the rod 45. This structure effectively prevents the apex 46*c* of the printing material supply tube 46 (FIG. 3) from hitting against the different position of the cartridge 50 from the printing material supply port 78*f* and thereby protects the printing material supply tube 46 from being damaged. This structure also reduces the positional misalignment between the central axis Ca of the printing material supply tube 46 (FIG. 3) and the central axis Ce of the printing material supply port 78*f* (FIG. 7A) and does not make any significant clearance between the printing material supply port 78*a* and the periphery of the printing material supply tube 46. This advantageously reduces the possibility of ink leakage from such clearance.

According to this embodiment, as shown in FIG. 3, the apex 46*c* of the printing material supply tube 46 and the positive Y-axis apex 45*c* of the rod 45 are located at the same position P in the Y-axis direction. The open end 53*f* of the first insertion hole 53 is provided on the negative Y-axis side to the printing material supply port 78*f* as shown in FIG. 8. This structure ensures easy attachment of the cartridge 50 to the cartridge mounting structure 42. The rod 45 is inserted into the first insertion hole 53 prior to insertion of the printing material supply tube 46 into the printing material supply port 78*f*, thus allowing effective positioning of the cartridge 50 relative to the cartridge mounting structure 42.

As shown in FIG. 7A, the cartridge 50 of the embodiment has the cartridge-side identification member 520 to identify the type of the cartridge 50, based on whether the cartridge-side identification member 520 fits the device-side identification member 420. When the wrong type of the cartridge 50 is inserted into the cartridge mounting structure 42, the identification members 520 and 420 bump into each other, so as to interfere with further insertion of the wrong type of the cartridge 50. This structure advantageously reduces the possibility that the wrong type of the cartridge 50 is connected with the printing material supply tube 46 and the wrong color ink is supplied through the printing material supply tube 46. As shown in FIGS. 9A and 9B, the fit between the device-side identification member 420 and the cartridge-side identification member 520 starts after insertion of the rod 45 into the first insertion hole 53. This effectively prevents the positional misalignment between the device-side identification member 420 and the cartridge-side identification member 520. This structure reduces the possibility of bad fit that the cartridge-side identification member 520 hits against the device-side identification member 420 when the correct type of the cartridge 50 is inserted into the cartridge mounting structure 42. This structure, on the other hand, causes the cartridge-side identification member 520 to hit against the device-side identification member 420 when the wrong type of the cartridge 50 is inserted into the cartridge mounting structure 42, so as to interfere with further insertion of the cartridge 50. This structure advantageously reduces the possibility that the wrong type of the cartridge 50 is connected with the printing material supply tube 46 and the wrong color ink is supplied through the printing material supply tube 46.

According to the embodiment, the positive Y-axis end 422*c* of the device-side identification member 420, as well as the apex 46*c* of the printing material supply tube 46 and the positive Y-axis apex 45*c* of the rod 45 are located at the same position P in the Y-axis direction. The end face 520*f* of the cartridge-side identification member 520 is provided on the positive Y-axis side to the open end 53*f* of the first insertion hole 53 and on the negative Y-axis side to the printing material supply port 78*f*. This structure ensures easy attachment of the cartridge 50 to the cartridge mounting structure 42. The fit between the cartridge-side identification member 520 and the device-side identification member 420 starts after insertion of the rod 45 into the first insertion hole 53 but before insertion of the printing material supply tube 46 into the printing material supply port 78*f*. According to this embodiment, the cartridge-side identification member 520 and the device-side identification member 420 are simply formed by the pattern of the ribs 522 and by the pattern of the ribs 422.

As shown in FIG. 7B, according to this embodiment, the first insertion hole 53 has the predetermined length in the Y-axis direction, and the area of the open end 53*f* on the negative Y-axis side is smaller than the area of the open end 53*g* on the positive Y-axis side. In other words, the open end 53*f* on the negative Y-axis side to receive the rod 45 first is wider than the other open end 53*g* on the positive Y-axis side. This structure enables the rod 45 to readily enter the first insertion hole 53 through the wider open end 53*f*, and insertion of the rod 45 into the other open end 53*g* on the positive Y-axis side ensures accurate positioning of the cartridge 50 to the cartridge mounting structure 42.

As shown in FIGS. 7B and 7C, according to this embodiment, the first insertion hole 53 includes the one side portion 53*y* between the joint 53*h* and the open end 53*f* on the negative Y-axis side and the other side portion 53*t* between the joint 53*h* and the open end 53*g* on the positive Y-axis side. The one side portion 53*y* is formed in the shape of a truncated cone having the circular cross section parallel to the X axis and the Z axis. As shown in FIGS. 7B, 7C and 7D, the other side portion 53*t* is formed in the columnar shape having the cross section parallel to the X axis and the Z axis, which is defined by the combination of the pair of straight lines 53*p*, 53*p* opposed to each other in the Z-axis direction and the pair of arcs 53*q*, 53*q* opposed to each other in the X-axis direction. At the joint 53*h*, the distance between the pair of straight lines 53*p*, 53*p* defining part of the cross section of the other side portion 53*t* is smaller than the diameter of the circle defining the cross section of the one side portion 53*y*. At the joint 53*h*, the diameter of the pair of arcs 53*q*, 53*q* defining the remaining part of the cross section of the other side portion 53*t* is equal to the diameter of the circle defining the cross section of the one side portion 53*y*. In the one side portion 53*y*, the area of the cross section gradually decreases from the open end 53*f* on the negative Y-axis side toward the joint 53*h*. The shape of the cross section changes to have the smaller length in the Z-axis direction but keep the same length at the joint 53*h* or at the entrance of the other side portion 53*g* in the X-axis direction. The shape and the area of the cross section do not change between the joint 53*h* and the open end 53*g* on the positive Y-axis side. This structure enables the rod 45 to be smoothly guided from the one side portion 53*y* to the other side portion 53*t*. The other side portion 53*t* has a clearance between the rod 45 and the first insertion hole 53 in the X-axis direction in order to smoothly guide the rod 45 to the open end 53*g* on the positive Y-axis side, while stabilizing the position of the rod 45 in the Z-axis direction to enable the cartridge 50 to be accurately positioned relative to the cartridge mounting structure 42. Positioning of the cartridge 50 relative to the cartridge mounting structure in the X-axis direction depends on the fit between the second cartridge projection 58 and the second rail 404, whilst positioning of the cartridge 50 relative to the cartridge mounting structure in the negative Y-axis direction depends on the abutment of the cartridge 50 (front face 532 in this embodiment) with the restriction members 406.

B. Modifications

The foregoing has described the invention in detail with reference to the illustrative embodiment. The invention is, however, not limited to the above embodiment, but a multiplicity of variations and modifications may be made to the embodiment without departing from the scope of the invention. Some examples of possible modifications are described below. The modifications described below are all on the basis of the above embodiment, so that the advantageous effects and various embodiments described above are similarly applicable to these modifications. The like parts and components to those of the above embodiment are expressed by the like symbols and are not specifically described here.

B-1. First Modification

Figure 17:
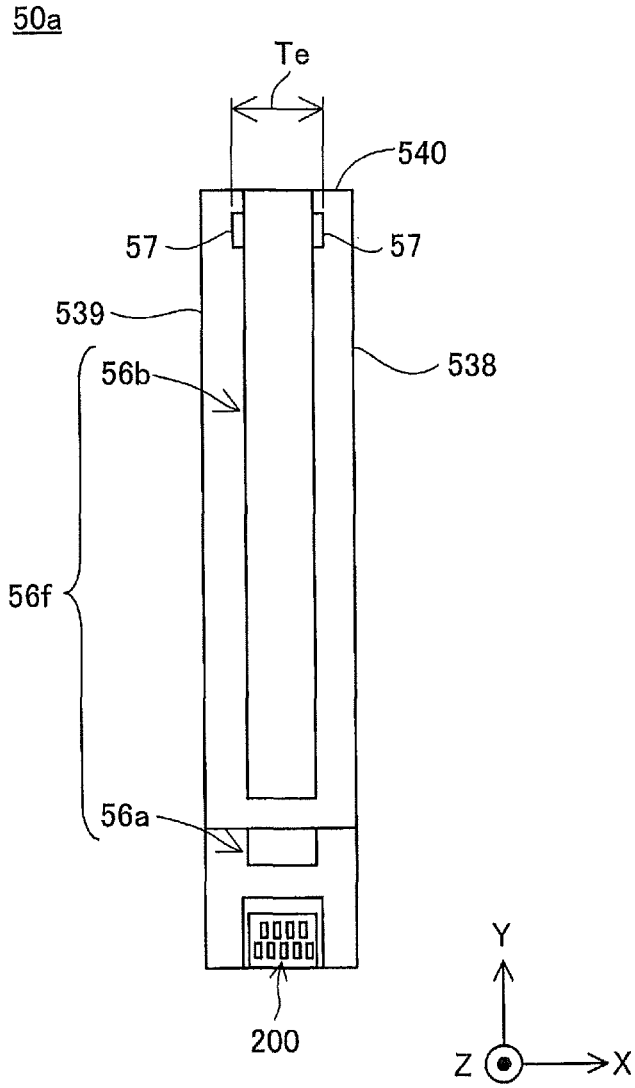
FIG. 17 illustrates a cartridge according to a first modification.

FIG. 17 illustrates a cartridge 50*a* according to a first modification. The lengths of the first cartridge projection 56 and the second cartridge projection 58 in the X-axis direction are constant and unchanged over the whole length according to the above embodiment but may be partly increased. According to this modification, the first case-side projection 56*b* provided on the first side face 534*b* of the protective case 84 has a pair of protrusions 57 protruded in the X-axis direction on the rear face 540-side, i.e., on the positive Y-axis side. An length Te of the first cartridge projection 56 at the location with the protrusions 57 in the X-axis direction is smaller than the length Ta of the first rail 402 (FIG. 2) in the X-axis direction. Although not being illustrated, the second case-side projection 58*b* similarly has a pair of protrusions. An length Tf (not shown) of the second cartridge projection 58 at the location with the protrusions (not shown) in the X-axis direction is smaller than the length Tb of the second rail 404 (FIG. 2) in the X-axis direction. The lengths satisfy the relationship of $Tc<Te<Ta<Td<Tf<Tb$ in the X-axis direction. Forming clearances between the first and second cartridge projections 56 and 58 and the first and second rails 402 and 404 ensures smoother insertion of the cartridge 50*a* into the cartridge mounting structure 42. The locations of the first and second cartridge projections 56 and 58 having the greater lengths (i.e., the locations with the protrusions) in the X-axis direction, in cooperation with the first and second rails 402 and 404, effectively restrict the motion of the positive Y-axis side of the cartridge 50*a* in the X-axis direction after attachment of the cartridge 50*a* to the cartridge mounting structure 42.

B-2. Second Modification

According to the above embodiment, the first insertion hole 53 is formed on the front face 532 at the middle position between the first side face 534 and the second side face 536. It is further preferable to locate the first insertion hole 53 on the front face 532 at the middle position of the third side face 538 and the fourth side face 539. This allows positioning of the cartridge 50 by the first insertion hole 53 and the rod 45 with the higher accuracy. The "middle position between the third side face 538 and the fourth side face 539" may not be the exactly middle position but may be substantially middle position with no substantial bias to either of the third and fourth side faces 538 and 539. For example, the "middle position" may include the position of the central axis Ce of the first insertion hole 53 within a range of 10% from the center position along the distance in the X-axis direction between the third side face 538 and the fourth side face 539. In order to locate the central axis Ce at the middle position as exactly as possible, it is preferable that the "middle position" includes a range within 7.5% from the center position along the distance in the X-axis direction between the third side face 538 and the fourth side face 539.

B-3. Third Modification

The open end 53*g* on the positive Y-axis side of the first insertion hole 53 is parallel to the plane parallel to the X axis and the Z axis according to the above embodiment, but may be inclined to this plane. As shown in FIGS. 14 and 15, when the printing material containing portion 70 contains ink at or above a certain level, the abutting element 132 of the lever member 120 is protruded in the negative Y-axis direction. The open end 53*g* on the positive Y-axis side of the first insertion hole 53 may be inclined to make its positive Z-axis side more recessed than its negative Z-axis side in the negative Y-axis direction, in order to prevent interference of the abutting element 132 of the lever member 120 with the open end 53*g*. The "area of the inclined open end 53*g*" means the area of the open end 53*g* projected to the plane parallel to the X axis and the Z axis.

B-4. Fourth Modification

The present invention is not restricted to the inkjet printer and its ink cartridge but is applicable to any of various printing devices configured to eject a liquid other than ink and its liquid container, for example, printing devices and their liquid containers given below:

(1) image recording device, such as a facsimile machine;

(2) printing device configured to eject color material used to manufacture color filters for image display devices, e.g., liquid crystal displays;

(3) printing device configured to eject electrode material used to form electrodes of, for example, organic EL (electroluminescence) displays and field emission displays (FED);

(4) printing device configured to eject a bioorganic material-containing liquid used to manufacture biochips;

(5) sample printing device used as a precision pipette;

(6) printing device of lubricating oil;

(7) printing device of resin solution;

(8) printing device for pinpoint spray of lubricating oil at precision machinery including watches and cameras;

(9) printing device configured to eject transparent resin solution, such as ultraviolet curable resin solution, onto the substrate, so as to manufacture a hemispherical microlens (optical lens) used for, for example, optical communication elements;

(10) printing device configured to spray an acidic or alkaline etching solution, in order to etch the substrate; and

(11) printing device equipped with printing head for ejecting a very small volume of droplets of another arbitrary liquid.

The "liquid droplet" means a state of liquid ejected from the printing device and may be in a granular shape, a teardrop shape or a tapered threadlike shape. The "liquid" herein may be any material ejectable by the printing device. The "liquid" may be any material in the liquid phase. For example, liquid-state materials of high viscosity or low viscosity, sols, gel water, various inorganic solvents and organic solvents, solutions, liquid resins and liquid metals (metal melts) are included in the "liquid". The "liquid" is not restricted to the liquid state as one of the three states of matter but includes solutions, dispersions and mixtures of the functional solid material particles, such as pigment particles or metal particles, solved in, dispersed in or mixed with a solvent. Typical examples of the liquid include ink described in the above embodiment and liquid crystal. The "ink" includes general water-based inks and oil-based inks, as well as various liquid compositions, such as gel inks and hot-melt inks.

What is claimed is:

1. A cartridge adapted to be removably attached to a cartridge mounting structure comprising a printing material supply tube fixed to a device front wall member and having a central axis extended in a predetermined direction, a rod provided on the device front wall member and having an axis parallel to the central axis and movable in a direction of the axis, and a sensor configured to detect displacement of the rod, wherein three mutually orthogonal special axes are X axis, Y axis and Z axis, directions along the X axis, the Y axis and the Z axis are respectively X-axis direction, Y-axis direction and Z-axis direction, a negative Y-axis direction represents a direction in which the cartridge is inserted into the cartridge mounting structure, and a positive Y-axis direction represents a direction in which the cartridge is removed from the cartridge mounting structure, the cartridge comprising:

a casing including:

first two faces opposed to each other in the Y-axis direction, one of the first two faces being a front face having an substantially rectangular shape located on the negative Y-axis side and having a length in the Z-axis direction greater than a length in the X-axis direction, and an another one of the first two faces being a rear face located on the positive Y-axis side;

second two faces opposed to each other in the Z-axis direction and intersecting the front face and the rear face, one of the second two faces being a first side face located on a positive Z-axis side, and an another one of the second two faces being a second side face located on a negative Z-axis side; and third two faces opposed to each other in the X-axis direction and intersecting the front face, the rear face, the first side face and the second side face, one of the third two faces being a third side face located on a positive X-axis side, and an another one of the third two faces being a fourth side face located on a negative X-axis side;

a printing material containing portion provided inside the casing;

a first insertion hole formed in the front face and adapted to receive the rod, the first insertion hole located on the front face at a middle position between the first side face and the second side face;

a second insertion hole formed in the front face and adapted to receive the printing material supply tube; and a printing material flow path provided inside the casing and having first and second ends, the first end being a printing material supply port adapted to receive the printing material supply tube therein and located at the second insertion hole, and the second end connected with the printing material containing portion.

2. The cartridge according to claim 1, wherein the printing material flow path has a detection chamber provided between the first and second ends, the detection chamber configured to vary volume with a change in internal pressure, and a lever member configured to be displaced with a variation in volume of the detection chamber, the lever member arranged to abut an apex of the rod and thereby moving the rod in the axial direction.

3. The cartridge according to claim 1, wherein the first insertion hole is further adapted to receive a rod cover surrounding periphery of the rod.

4. The cartridge according to claim 1, the casing further comprising:

a protective case having an opening on the negative Y-axis side and accommodating the printing material containing portion therein; and a cap provided on the negative Y-axis side of the casing and attached to the protective case to close the opening of the protective case, wherein the second insertion hole and the first insertion hole are provided in the cap.

5. The cartridge according to claim 4, further comprising:

cartridge-side terminals adapted to contact with device-side terminals provided on the cartridge mounting structure in an attached state of the cartridge to the cartridge mounting structure, wherein the cartridge-side terminals are provided on the cap.

6. The cartridge according to claim 4, wherein the cap has a first side face forming a part of the first side face of the casing and a second side face faulting a part of the second side face of the casing, a first projection protruded in the positive Z-axis direction is provided on the first side face of the cap, the first projection is adapted to be guided by a first rail provided on a first device side wall member, a second projection protruded in a negative Z-axis direction is provided on the second side face of the cap, the second projection is adapted to be guided by a second rail provided on a second device side wall member, extended in the Y-axis direction and having a different length in the X-axis direction from the first rail, and the first projection and the second projection have different lengths in the X-axis direction.

7. The cartridge according to claim 6, wherein the protective case has a first side face forming another part of the first side face of the casing and a second side face forming another part of the second side face of the casing, a first case-side projection protruded in the positive Z-axis direction is provided on the first side face of the protective case, the first case-side projection is adapted to be guided by the first rail, a second case-side projection protruded in the negative Z-axis direction is provided on the second side face of the protective case, the second case-side projection is adapted to be guided by the second rail, and one part located on the positive Y-axis side of at least one of the first case-side projection and the second case-side projection has a protrusion protruded in the X-axis direction, such that the one part has a greater length in the X-axis direction than a length in the X-axis direction of another part located on the negative Y-axis side of the one part.

8. The cartridge according to claim 1, wherein the first insertion hole has one open end on the negative Y-axis side, the open end is provided at a position to receive the rod before the printing material supply port receiving the printing material supply tube.

9. The cartridge according to claim 8, wherein the one open end of the first insertion hole is located on the negative Y-axis side to the printing material supply port.

10. The cartridge according to of claim 8, further comprising:

a cartridge-side identification member configured to identify type of the cartridge, based on whether the cartridge-side identification member is fit with a device-side identification member provided on the cartridge mounting structure, wherein the cartridge-side identification member is configured to fit with the device-side identification member after the first insertion hole receiving the rod and before the printing material supply port receiving the printing material supply tube.

11. The cartridge according to claim 10, wherein an end of the cartridge-side identification member in the negative Y-axis direction is provided on the positive Y-axis side to the one open end of the first insertion hole and on the negative Y-axis side to the printing material supply port.

12. The cartridge according to claim 1, wherein the first insertion hole has a predetermined length in the Y-axis direction, and the one open end on the negative Y-axis side of the first insertion hole has a smaller area than an area of an another open end on the positive Y-axis side of the first insertion hole.

13. The cartridge according to claim 12, wherein the first insertion hole includes one side portion extending from a joint to the one open end on the negative Y-axis side and another side portion extending from the joint to the another open end on the positive Y-axis side, the one side portion is formed in a truncated cone shape having a cross section in the shape of a circle parallel to the X axis and the Z axis, the another side portion is formed in a columnar shape having a cross section parallel to the X axis and the Z axis, which is defined by a combination of a pair of straight lines opposed to each other in the Z-axis direction and a pair of arcs opposed to each other in the X-axis direction, and at the joint, a distance between the pair of straight lines defining a part of the cross section of the another side portion is smaller than a diameter of the circle defining the cross section of the one end portion, and a diameter of the pair of arcs defining another part of the cross section of the another side portion is equal to the diameter of the circle defining the cross section of the one end portion.

* * * * *